US008619019B2

(12) United States Patent
Lee et al.

(10) Patent No.: US 8,619,019 B2
(45) Date of Patent: Dec. 31, 2013

(54) DISPLAY APPARATUS AND METHOD OF DRIVING THE DISPLAY APPARATUS

(75) Inventors: Jun-woo Lee, Anyang-si (KR); Hee-seop Kim, Hwaseong-si (KR); Chang-hun Lee, Yongin-si (KR); Eun-hee Han, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1079 days.

(21) Appl. No.: 11/591,728

(22) Filed: Nov. 2, 2006

(65) Prior Publication Data

US 2007/0139356 A1 Jun. 21, 2007

(30) Foreign Application Priority Data

Dec. 16, 2005 (KR) ..... 10-2005-0124669

(51) Int. Cl.
*G09G 3/38* (2006.01)
*G09G 3/20* (2006.01)
*G09G 3/30* (2006.01)

(52) U.S. Cl.
USPC ..... 345/103; 345/55; 345/79; 345/87

(58) Field of Classification Search
USPC ..... 345/103
See application file for complete search history.

(56) References Cited

U.S. PATENT DOCUMENTS 5,576,863 A * 11/1996 Aoki et al. ..... 349/124
6,563,481 B1 * 5/2003 Watanabe et al. ..... 345/87
6,724,359 B2 * 4/2004 Yamamoto et al. ..... 345/92
6,850,305 B2 * 2/2005 Hsieh et al. ..... 349/144
7,019,725 B1 * 3/2006 Lee et al. ..... 345/98
7,215,309 B2 5/2007 Yamato et al.
7,355,666 B2 4/2008 Song et al.
8,159,430 B2 4/2012 Song et al.

(Continued)

FOREIGN PATENT DOCUMENTS

CN 1532601 9/2004
JP 08-320674 12/1996

(Continued)

*Primary Examiner* — Bipin Shalwala
*Assistant Examiner* — Benyam Ketema
(74) *Attorney, Agent, or Firm* — F. Chau & Associates, LLC

(57) ABSTRACT

A display apparatus including a plurality of data lines which transmit a data signal received from a data driving unit, a plurality of first gate lines and a plurality of second gate lines, which cross the data lines and are arranged in such a manner that the first gate lines and the second gate lines alternate with each other, a plurality of pixels which are defined by the data lines, the first gate lines, and the second gate lines, each of the pixels including a first sub-pixel electrode to which a first data voltage is applied by a first switching device connected to one of the first gate lines and a second sub-pixel electrode to which a second data voltage is applied by a second switching device connected to one of the second gate lines, and a gate driving unit which selects a scanning group including two or more first gate lines and two or more second gate lines, applies a gate-on voltage to the first gate lines of the scanning group according to a first predetermined scanning order, and applies the gate-on voltage to the second gate lines of the scanning group according to a second predetermined scanning order.

20 Claims, 18 Drawing Sheets

(56) References Cited

U.S. PATENT DOCUMENTS

| | | | | |
|---|---|---|---|---|
| 2002/0047822 | A1* | 4/2002 | Senda et al. | 345/90 |
| 2002/0196208 | A1* | 12/2002 | Nanno et al. | 345/55 |
| 2004/0012554 | A1* | 1/2004 | Song et al. | 345/92 |
| 2004/0183768 | A1* | 9/2004 | Yamato et al. | 345/98 |
| 2004/0263760 | A1* | 12/2004 | Kodate et al. | 349/151 |
| 2005/0051835 | A1* | 3/2005 | Kang et al. | 257/315 |
| 2005/0078075 | A1 | 4/2005 | Joo et al. | |
| 2005/0227764 | A1 | 10/2005 | Cantu et al. | |
| 2006/0038942 | A1* | 2/2006 | Luo | 349/114 |
| 2006/0208984 | A1* | 9/2006 | Kim et al. | 345/90 |
| 2008/0165298 | A1 | 7/2008 | Song et al. | |

FOREIGN PATENT DOCUMENTS

| | | |
|---|---|---|
| JP | 09-244046 | 9/1997 |
| JP | 2002-072985 | 3/2002 |
| JP | 2003-215539 | 7/2003 |
| KR | 1020030008044 | 1/2003 |
| KR | 1020040008919 | 1/2004 |
| KR | 1020040082948 | 9/2004 |
| KR | 1020050053847 | 6/2005 |

* cited by examiner

DISPLAY APPARATUS AND METHOD OF DRIVING THE DISPLAY APPARATUS

CROSS-REFERENCE TO RELATED PATENT APPLICATION

This application claims priority to Korean Patent Application No. 2005-0124669, filed on Dec. 16, 2005, in the Korean Intellectual Property Office, the disclosure of which is incorporated by reference herein.

BACKGROUND OF THE INVENTION

1. Technical Field

The present disclosure relates to a display apparatus, and more particularly, to a display apparatus capable of reducing the load of a data driving unit and a method of driving the display apparatus.

2. Discussion of the Related Art

With the development of an information society, demands for various display apparatuses have increased. Accordingly, various flat display apparatuses such as a liquid crystal display (LCD), an electroluminescent display (ELD), and a plasma display panel (PDP), have been developed and used in a wide variety of applications. The LCD is widely utilized for various electronic apparatuses because it has excellent picture quality, is thin, light in weight, and has a low power consumption.

Liquid crystal displays (LCDs) have been the most widely used type of flat panel display device in recent years. LCDs are comprised of two substrates on which a plurality of electrodes are formed and a liquid crystal layer is interposed between the two substrates.

An electric field is generated in the liquid crystal layer by applying a data voltage to pixel electrodes and applying a common voltage to a common electrode. A desired image is obtained by adjusting the electric field to control the amount of light transmitted through the liquid crystal layer. The transmittance and response speed of liquid crystal molecules in the liquid crystal layer affect the luminance and afterimage property of an LCD and thus need to be controlled in order to improve the picture quality of the LCD. Recently, research has been performed on how to control the intensity and orientation of an electric field applied to pixels of an LCD in which pixels are divided into 2 or more sub-pixels. Each sub-pixel comprises a sub-pixel electrode and sub-pixel electrodes in each pixel may include different switching devices and thus can be provided with different voltages.

In a method of controlling an electric field in liquid crystal molecules using sub-pixels, voltages having opposite polarities with respect to a common voltage are respectively applied to sub-pixel electrodes in each pixel using corresponding switching devices for the sub-pixel electrodes. When the voltages are applied, the period that the corresponding switching devices are enabled decreases 2 or more times as compared to when voltages are applied to pixel electrodes which are not divided into 2 or more sub-pixel electrodes. Thus, data voltages supplied by a data driving unit must be quickly switched from one voltage level to another within a short period of time, thereby placing a huge burden on the data driving unit and increasing the power consumption of the data driving unit. There exists a need for a display apparatus capable of reducing the load on a data driving unit.

SUMMARY OF THE INVENTION

According to an exemplary embodiment of the present invention, there is provided a display apparatus including a plurality of data lines which transmit a data signal received from a data driving unit, a plurality of first gate lines and a plurality of second gate lines, which cross the data lines and are arranged in such a manner that the first gate lines and the second gate lines alternate with each other, a plurality of pixels which are defined by the data lines, the first gate lines, and the second gate lines, each of the pixels comprising a first sub-pixel electrode to which a first data voltage is applied by a first switching device connected to one of the first gate lines and a second sub-pixel electrode to which a second data voltage is applied by a second switching device connected to one of the second gate lines, and a gate driving unit which selects a scanning group comprising two or more first gate lines and two or more second gate lines, applies a gate-on voltage to the first gate lines of the scanning group according to a first predetermined scanning order, and applies the gate-on voltage to the second gate lines of the scanning group according to a second predetermined scanning order.

According to an exemplary embodiment of the present invention, there is provided a display apparatus including a plurality of data lines which transmit a data signal received from a data driving unit, a plurality of first gate lines and a plurality of second gate lines, which cross the data lines and are arranged in such a manner that the first gate lines and the second gate lines alternate with each other, a plurality of pixels which are defined by the data lines, the first gate lines, and the second gate lines, each of the pixels comprising a first sub-pixel electrode to which a first data voltage is applied by a first switching device connected to one of the first gate lines and a second sub-pixel electrode to which a second data voltage is applied by a second switching device connected to one of the second gate lines, and a gate driving unit which selects first and second scanning groups, each comprising two or more first gate lines and two or more second gate lines, applies a gate-on voltage to the first gate lines of each of the first and second scanning groups according to a first predetermined scanning order, and applies the gate-on voltage to the second gate lines of each of the first and second scanning groups according to a second predetermined scanning order, wherein the first and second scanning groups do not have any gate lines in common.

According to an exemplary embodiment of the present invention, there is provided a method of driving a display apparatus comprising a plurality of data lines which transmit a data signal, a plurality of first gate lines and a plurality of second gate lines which cross the data lines and are arranged in such a manner that a first gate line and a second gate line alternate with each other, and a plurality of pixels which are defined by the data lines, the first gate lines, and the second gate lines, each of the pixels comprising a first sub-pixel electrode to which a first data voltage is applied by a first switching device connected to one of the first gate lines and a second sub-pixel electrode to which a second data voltage is applied by a second switching device connected to one of the second gate lines, the method including selecting a scanning group comprising two or more first gate lines and two or more second gate lines, applying a gate-on voltage to the first gate lines of the scanning group according to a first predetermined scanning order, and applying the gate-on voltage to the second gate lines of the scanning group according to a second predetermined scanning order.

BRIEF DESCRIPTION OF THE DRAWINGS

The above and other features of the present invention will become more apparent by describing in detail exemplary embodiments thereof with reference to the attached drawings in which.

DETAILED DESCRIPTION OF EXEMPLARY EMBODIMENTS

Hereinafter, exemplary embodiments of the present invention will now be described more fully with reference to the attached drawings.

Figure 1:
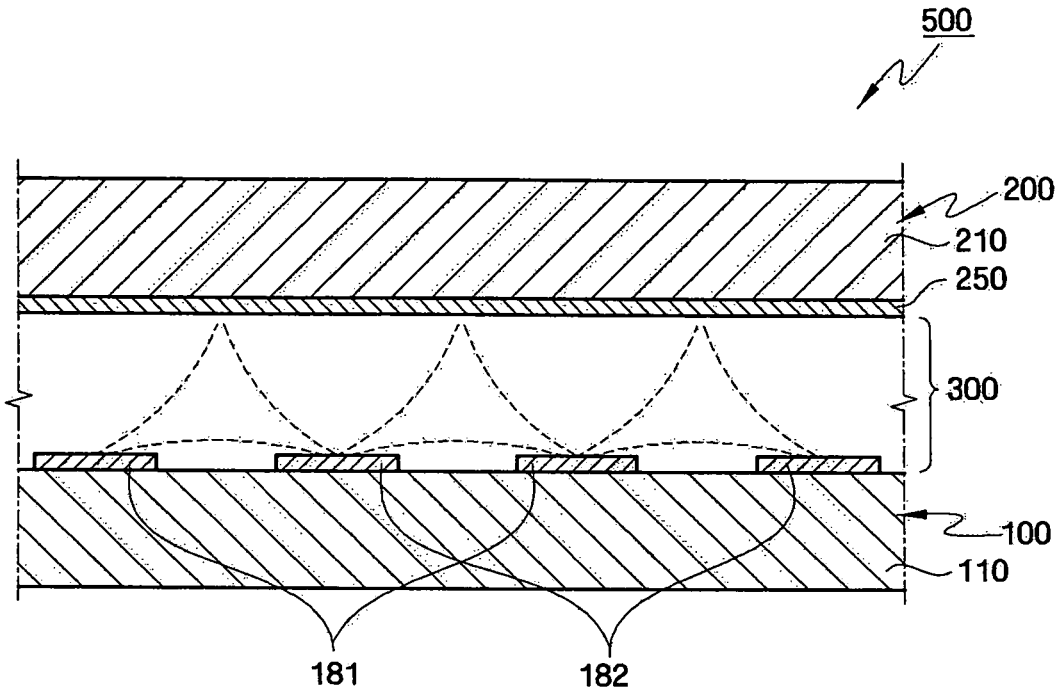
FIG. 1 is a schematic cross-sectional view of a liquid crystal display (LCD) device according to an exemplary embodiment of the present invention.

FIG. 1 is a schematic cross-sectional view of a liquid crystal display (LCD) according to an exemplary embodiment of the present invention.

Referring to FIG. 1, a liquid crystal display (LCD) 500 includes a first substrate 100, a second substrate 200 which faces the first substrate 100, and a liquid crystal layer 300 which is interposed between the first substrate 100 and the second substrate 200. A structure comprised of the first substrate 100, the second substrate 200, and the liquid crystal layer 300 may be referred to as a liquid crystal panel.

The first substrate 100 includes a first insulation substrate 110 and a plurality of pixel electrodes formed on the top surface of the first insulation substrate 110. In detail, the first substrate 100 includes a plurality of pixels which are arranged in a matrix form, and each of the pixels comprises a pixel electrode.

A pixel electrode includes a first sub-pixel electrode 181 and a second sub-pixel electrode 182. The first and second sub-pixel electrodes 181 and 182 are spaced apart and electrically insulated from each other. Two independent switching devices are respectively connected to the first and second sub-pixel electrodes 181 and 182, and thus, independent data voltages can be respectively applied to the first and second sub-pixel electrodes 181 and 182.

The second substrate 200 includes a second insulation substrate 210 and a common electrode 250 formed on the bottom surface of the second substrate 200. The common electrode 250 faces the pixel electrodes on the first substrate 100 and is on the opposite side of the liquid crystal layer 300 relative to the pixel electrodes. The common electrode 250 generates an electric field in the liquid crystal layer 300 together with the pixel electrodes. The liquid crystal layer 300 is comprised of a plurality of liquid crystal molecules (not shown). The liquid crystal molecules rotate according to the electric field generated in the liquid crystal layer 300 so that the transmittance of the liquid crystal panel changes.

A first alignment layer (not shown) covers the pixel electrodes on the first substrate 100, and a second alignment layer (not shown) covers the common electrode 250 on the second substrate 200. Here, the first and second alignment layers may be horizontal alignment layers which initially align the liquid crystal molecules of the liquid crystal layer 300 in a horizontal direction before an electric field is applied to the liquid crystal layer 300. When the first and second alignment layers are horizontal alignment layers, the first alignment layer may be rubbed in a first direction, and the second alignment layer may be rubbed in a second direction, forming an angle of 180 degrees with the first direction, i.e., opposite to the first direction.

The adjustment of an electric field generated in the liquid crystal layer 300 and the influence of the adjustment of the electric field on the rotation and response speed of the liquid crystal molecules of the liquid crystal layer 300 will now be described with reference to FIG. 1. Dotted lines represent orientations of an electric field.

For example, when a data voltage of 14 V is applied to the first sub-pixel electrode 181 on the first substrate 100, a data voltage of 0 V is applied to the second sub-pixel electrode 182 on the first substrate 100, and a reference voltage (e.g., a common voltage) of 7 V is applied to the common electrode 250 on the second substrate 200. An electric potential difference of 7 V is generated between the first sub-pixel electrode 181 and the common electrode 250, and an electric potential difference of −7 V is generated between the second sub-pixel electrode 182 and the common electrode 250. The degree to which the liquid crystal molecules of the liquid crystal layer 300 rotate is affected by the absolute value of the electric potential difference between the first or second sub-pixel electrode 181 or 182 and the common electrode 250. The degree to which liquid crystal molecules between the first sub-pixel electrode 181 and the common electrode 250 rotate is substantially similar to the degree to which liquid crystal molecules between the second sub-pixel electrode 182 and the common electrode 250 rotate.

Since the first and second sub-pixel electrodes 181 and 182 are a predetermined distance apart, a vertical electric field is bent due to the distance between the first and second sub-pixel electrodes 181 and 182, thus generating a fringe field including a horizontal electric field.

An electric potential difference of 14 V is generated between the first sub-pixel electrode 181 and the second sub-pixel electrode 182. Due to the electric potential difference between the first and second sub-pixel electrodes 181 and 182, a lateral field is generated between the first and second sub-pixel electrodes 181 and 182. The lateral field and the fringe field increase horizontal electric field components, thereby increasing the rotational force and response speed of the liquid crystal molecules of the liquid crystal layer 300.

Figure 2:
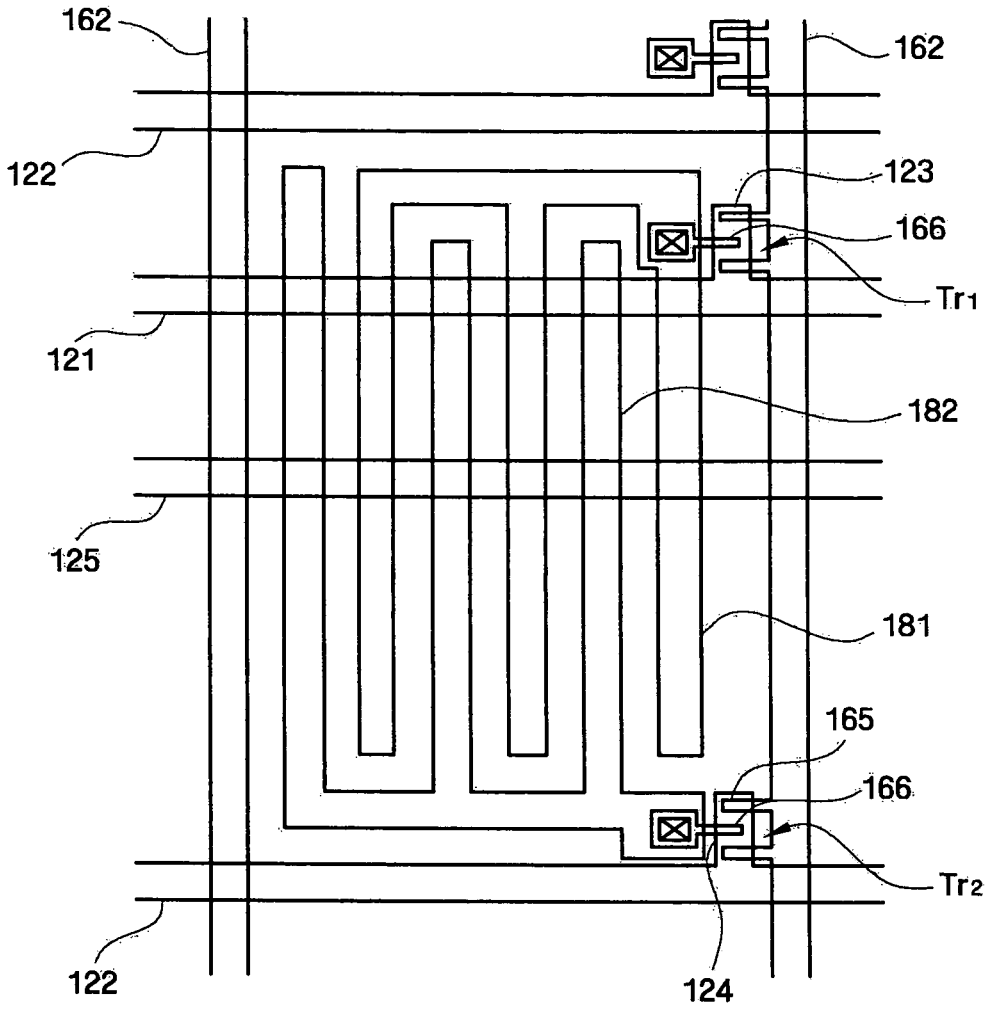
FIG. 2 is a layout of a unit pixel of a first substrate according to an exemplary embodiment of the present invention.

FIG. 2 is a layout of a unit pixel of a first substrate according to an exemplary embodiment of the present invention.

Referring to FIG. 2, first gate lines 121 and second gate lines 122 are formed in a first direction, and data lines 162 are formed in a second direction.

A pixel is defined by two adjacent second gate lines 122 and two adjacent data lines 162 which cross each other. One of the first gate lines 121 is formed between the two adjacent second gate lines 122 and extends across the pixel. However, the first gate lines 121 and the second gate lines 122 may be alternately arranged. In an exemplary embodiment, every odd-numbered gate line may be one of the first gate lines 121, and every even-numbered gate line may be one of the second gate lines 122. A control signal may be applied across one of the first gate lines 122 to a first thin film transistor (TFT) Tr1 connected to a first sub-pixel electrode 181, and a control signal may be applied across one of the second gate lines 122 to a second TFT Tr2 connected to a second sub-pixel electrode 182. The first and second gate lines 121 and 122 and the data lines 162 may be insulated from one another by a gate insulation layer.

The first sub-pixel electrode 181 and the second sub-pixel electrode 182, which are electrically separated from each other, are formed in a pixel region. The first sub-pixel electrode 181 extends in the first direction, and the second sub-pixel electrode 182 extends in the second direction. A portion of the first gate line 121 is used to form a first gate electrode 123, and a portion of each of the second gate lines 122 is used to form second gate electrodes 124. Portions of one of the data lines 162 extend into the pixel region, thereby forming source electrodes 165. Drain electrodes 166 are located on the opposite sides of the first and second gate electrodes 123 and 124 relative to the source electrodes 165. The first gate electrode 123, the source electrodes 165, and a drain electrode 166 constitute the first TFT tr1 which switches the first sub-pixel electrode 181. The second gate electrodes 124, the source electrodes 165, and a drain electrode 166 constitute the second TFT Tr2 which switches the second sub-pixel electrode 182.

Referring to FIG. 2, a storage electrode line 125 extends in the same direction as the first and second gate lines 121 and 122. The storage electrode line 125 overlaps the first sub-pixel electrode 181, thereby forming a first storage capacitor. The storage electrode line 125 also overlaps the second sub-pixel electrode 182, thereby forming a second storage capacitor. The storage electrode line 125 is optional.

Figure 3:
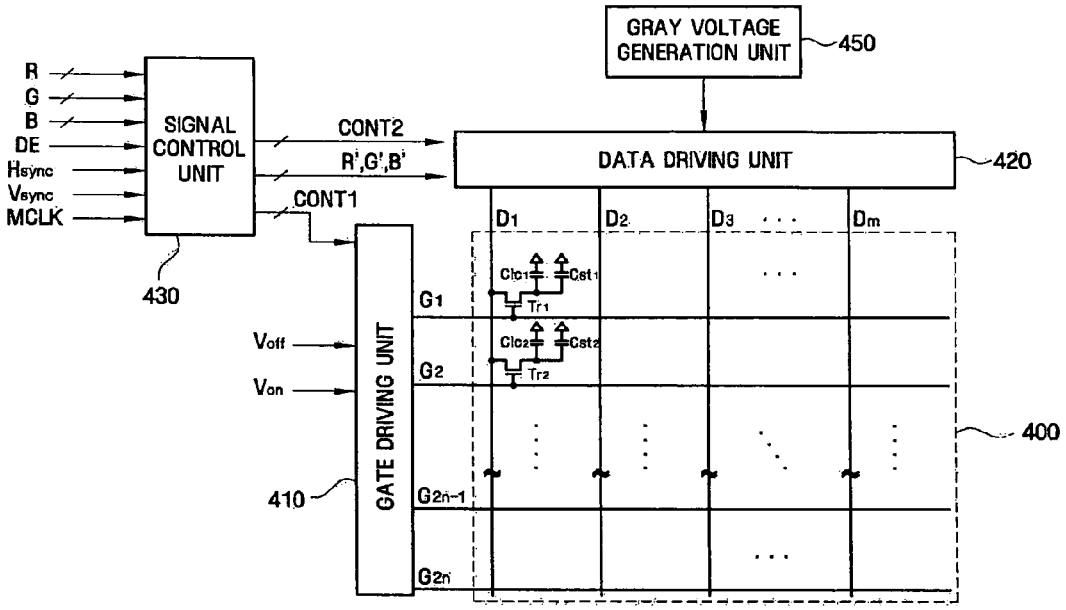
FIG. 3 is a block diagram of an LCD according to an exemplary embodiment of the present invention.

FIG. 3 is a block diagram of an LCD according to an exemplary embodiment of the present invention, illustrating an equivalent circuit of a pixel of a liquid crystal panel 400.

Referring to FIG. 3, a first TFT Tr1 is electrically connected to a plurality of first gate lines $G_1$ through $G_{2n-1}$ and a plurality of data lines $D_1$ through $D_m$, and a first liquid crystal capacitor $C_{lc1}$ and a first storage capacitor $C_{st1}$ are connected in parallel to a drain electrode of the first TFT Tr1. A first electrode of the first liquid crystal capacitor $C_{lc1}$ is a first sub-pixel electrode, and a second electrode of the first liquid crystal capacitor $C_{lc1}$ is a common electrode. A first electrode of the first storage capacitor $C_{st1}$ is the first sub-pixel electrode, and a second electrode of the first storage capacitor $C_{st1}$ is a storage electrode.

A second TFT Tr2 is electrically connected to a plurality of second gate electrodes $G_2$ through $G_{2n}$ and the plurality of data lines $D_1$ through $D_m$. A second liquid crystal capacitor $C_{lc2}$ and a second storage capacitor $C_{st2}$ are connected in parallel to a drain electrode of the second TFT Tr2. A first electrode of the second liquid crystal capacitor $C_{lc2}$ is the second sub-pixel electrode, and a second electrode of the second liquid crystal capacitor $C_{lc2}$ is a common electrode. A first electrode of the second storage capacitor $C_{st2}$ is the second sub-pixel electrode, and a second electrode of the second storage capacitor $C_{st2}$ is a storage electrode.

The LCD 500 includes a gate driving unit 410, a data driving unit 420, a signal control unit 430, and a gray voltage generation unit 450. The data driving unit 410 drives the liquid crystal panel 400. The signal control unit 430 controls the gate driving unit 410 and the data driving unit 420. The gray voltage generation unit 450 generates a plurality of gray voltages.

The signal control unit 430 is connected to the gate driving unit 410 and the data driving unit 420, generates a control signal for controlling the gate driving unit 410 or the data driving unit 420, and transmits the control signal to the gate driving unit 410 or the data driving unit 420. The signal control unit 430 receives input control signals for controlling the displaying of an image signal (R, G, B) from an external graphic controller (not shown). Examples of the input control signals include a vertical synchronization signal $V_{sync}$, a horizontal synchronization signal $H_{sync}$, a main clock signal MCLK, and a data enable signal DE.

The signal control unit 430 generates a gate control signal CONT1 and a data control signal CONT2 based on the input control signals, appropriately processes the image signal (R, G, B) according to the operating conditions of the liquid crystal panel 400, provides the gate driving unit 410 with the gate control signal CONT1, and provides the data driving unit 420 with the data control signal CONT2 and the processing result, i.e., image data (R', G', B').

The data driving unit 420 receives the image data (R', G', B') in response to the data control signal CONT2 and selects a gray voltage corresponding to the image data (R', G', B') from among a plurality of gray voltages provided by the gray voltage generation unit 450, thereby converting the image data (R', G', B') into a predetermined data voltage.

The gate driving unit 410 enables the TFTs connected to the plurality of gate lines $G_1$ through $G_{2n}$ by applying a gate-on voltage $V_{on}$ to the plurality of gate lines $G_1$ through $G_{2n}$ in response to the gate control signal CONT1. The gate driving unit 410 may select a scanning group including the first gate lines $G_1$ through $G_{2n-1}$ and the second gate lines $G_2$ through $G_{2n}$. Thereafter, the gate driving unit 410 applies the gate-on voltage $V_{on}$ to the first gate lines $G_1$ through $G_{2n-1}$ and the second gate lines $G_2$ through $G_{2n}$ according to a predetermined scanning order. The gate control signal CONT1 includes a gate clock signal and a gate signal which has gate on/off information. The gate control signal CONT1 may also include a selection signal for determining the predetermined scanning order.

The gate-on voltage $V_{on}$ and a gate-off voltage $V_{off}$, which are generated by a driving voltage generation unit (not shown), are applied to the gate driving unit 410.

Figure 4:
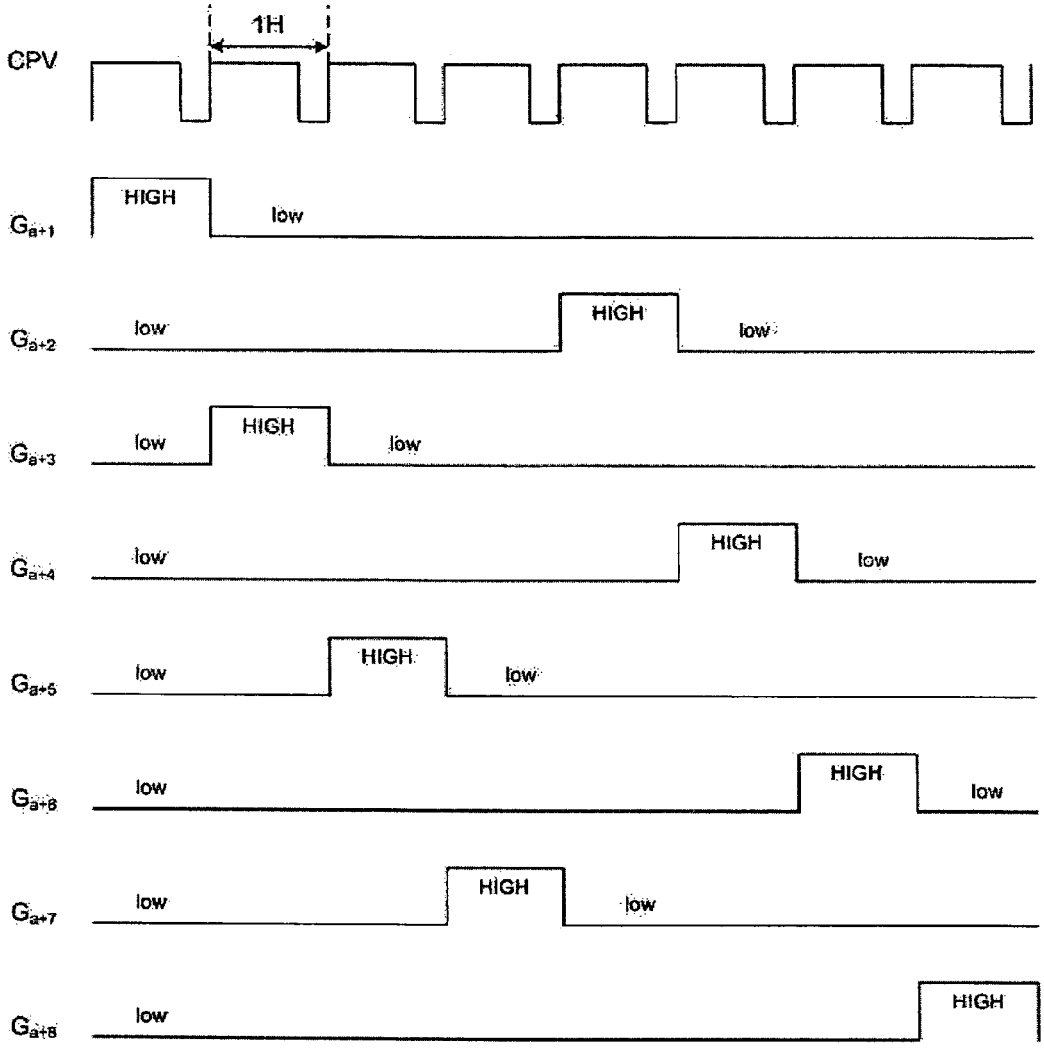
FIG. 4 is a diagram illustrating the waveforms of a gate clock signal and gate signals of an LCD according to an exemplary embodiment of the present invention.

FIG. 4 is a diagram illustrating the waveforms of a gate clock signal and gate signals of an LCD according to an exemplary embodiment of the present invention.

Referring to FIGS. 3 and 4, a gate signal includes a logic high period during which the gate-on voltage $V_{on}$ is applied and a logic low period during which the gate-off voltage $V_{off}$ is applied. The gate signal enables the gate-on voltage $V_{on}$ to be applied to a current gate line in synchronization with a rising edge of the gate clock signal CPV received from the signal control unit 430. The gate signal maintains a logic high level for one cycle of the gate clock signal CPV (i.e., a horizontal period; 1H) and becomes logic low in synchronization with a subsequent rising edge of the gate clock signal CPV, thus enabling the gate-off voltage $V_{off}$ to be applied to the current gate line. The gate signal of a logic high level is then applied to a subsequent gate line, thus enabling the gate-on voltage $V_{on}$ to be applied to the subsequent gate line.

The predetermined scanning order is determined for the scanning group including the first gate lines $G_1$ through $G_{2n-1}$ and the second gate lines $G_2$ through $G_{2n}$. The gate driving unit 410 selects at least one scanning group, scans all of a plurality of gate lines belonging to the selected group first, and then scans other gate lines not belonging to the selected scanning group. Once the scanning of a plurality of gate lines belonging to a predetermined scanning group begins, other gate lines not belonging to the predetermined scanning group are not scanned until the scanning of the gate lines belonging to the predetermined scanning group is terminated. Either the gate lines belonging to the predetermined scanning group or the other gate lines not belonging to the predetermined scanning group may be scanned first.

The gate driving unit 410 may select two or more scanning groups. For example, the gate driving unit 410 may select twelve scanning groups, each including 72 gate lines, or eight scanning groups, each including 36 gate lines, from a liquid crystal panel comprising a total of 1536 gate lines. Various different scanning orders can be used to scan a plurality of gate lines included in each of the selected scanning groups. Once the scanning of the gate lines in one of the selected scanning groups begins, the gate lines belonging to the other selected scanning groups are not scanned until the scanning of the gate lines currently being scanned is terminated. However, the present invention is not limited to scanning in only this order and two or more scanning groups may be scanned at the same time.

When the gate driving unit 410 selects a scanning group including four first gate lines $G_{a+1}$, $G_{a+3}$, $G_{a+5}$, and $G_{a+7}$ and four second gate lines $G_{a+2}$, $G_{a+4}$, $G_{a+6}$, and $G_{a+8}$, the first gate lines $G_{a+1}$, $G_{a+3}$, $G_{a+5}$, and $G_{a+7}$ may be scanned first, and then the second gate lines $G_{a+2}$, $G_{a+4}$, $G_{a+6}$, and $G_{a+8}$ may be scanned second.

Referring to FIG. 4, the gate-on voltage $V_{on}$ is applied to the first gate line $G_{a+1}$ in synchronization with a first rising edge of the gate clock signal CPV. The first gate line $G_{a+1}$ is the first gate line in the scanning group selected by the gate driving unit 410. Thereafter, the gate-off voltage $V_{off}$ is applied to the first gate line $G_{a+1}$ in synchronization with a second rising edge of the gate clock signal CPV, while the gate-on voltage $V_{on}$ is applied to the first gate line $G_{a+3}$, which is the third gate line in the selected scanning group. Likewise, the gate-on voltage is sequentially applied to the first gate line $G_{a+5}$, which is the fifth gate line in the selected scanning group, and the first gate line $G_{a+7}$, which is the seventh gate line in the selected scanning group.

Thereafter, the gate-off voltage $V_{off}$ is applied to the first gate line $G_{a+7}$ in synchronization with a fifth rising edge of the gate clock signal CPV, while the gate-on voltage is applied to the second gate line $G_{a+2}$, which is the second gate line in the selected scanning group. Likewise, the gate-on voltage is sequentially applied to the second gate line $G_{a+4}$, which is the fourth gate line in the selected scanning group, the second gate line $G_{a+6}$, which is the sixth gate line in the selected scanning group, and the second gate line $G_{a+8}$, which is the eighth gate line in the selected scanning group.

FIGS. 5 through 8 illustrate a method of sequentially applying a data voltage to a plurality of sub-pixel electrodes of a first substrate according to an exemplary embodiment of the present invention.

Referring to FIGS. 5 through 8, a plurality of rectangular pixels are illustrated. Each of the pixels comprises two sub-pixel electrodes, i.e., first and second sub-pixel electrodes 181 and 182. Even though the first sub-pixel electrodes 181 and the respective second sub-pixel electrodes 182 are electrically separated, they are schematically illustrated in FIGS. 5 through 8 as being connected. In FIGS. 5 through 8, first and second sub-pixel electrodes 181 and 182 that have not yet been supplied with a data voltage for a current frame are charged with a data voltage for a previous frame and are not marked with any symbol. First and second sub-pixel electrodes 181 and 182 that are supplied with a positive data voltage for a current frame are marked with a "+" symbol. First and second sub-pixel electrodes 181 and 182 that are supplied with a negative data voltage for the current frame are marked with a "−" symbol. A positive data voltage is applied to the first sub-pixel electrodes 181 and a negative data voltage is applied to the second sub-pixel electrodes 182. However, according to an exemplary embodiment of the present invention, a negative data voltage is applied to the first sub-pixel electrodes 181 and a positive data voltage is applied to the second sub-pixel electrodes 182.

Figure 5:
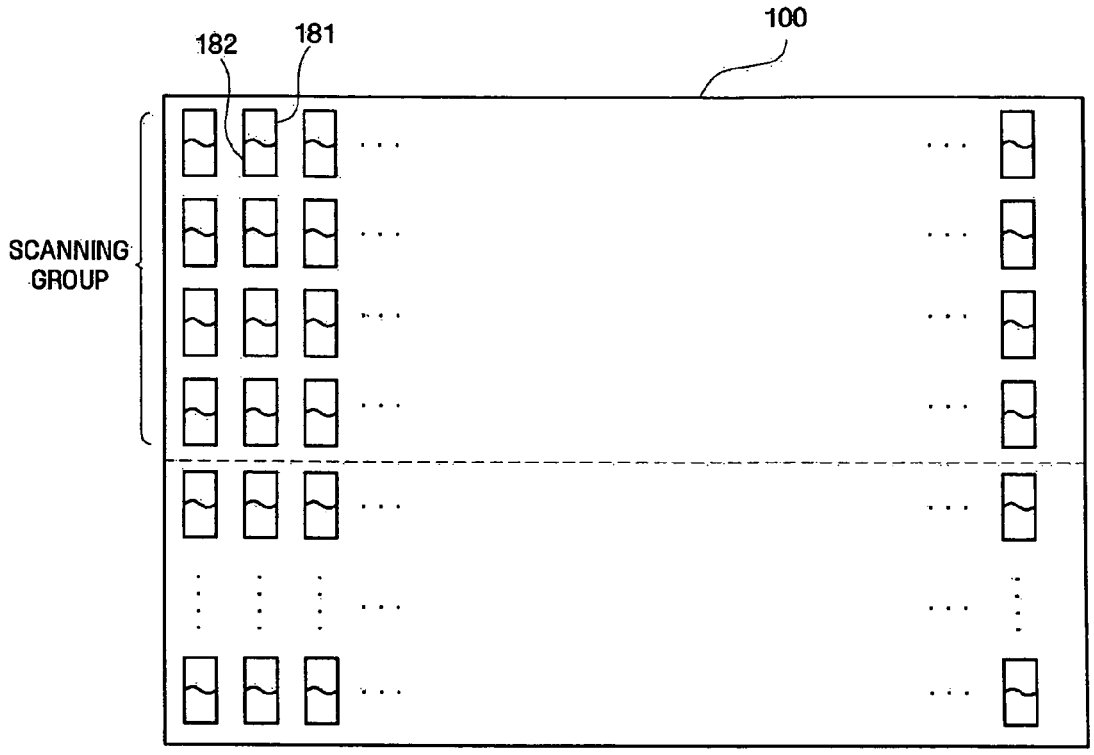
FIGS. 5 through 8 illustrate a method of sequentially applying a data voltage to a plurality of sub-pixel electrodes of a first substrate according to an exemplary embodiment of the present invention.

Referring to FIGS. 4 and 5, a scanning group including two or more first gate lines and two or more second gate lines is selected. Referring to FIG. 5, a scanning group including the first four adjacent gate lines from the top of a first substrate 100 may be selected.

Figure 6:
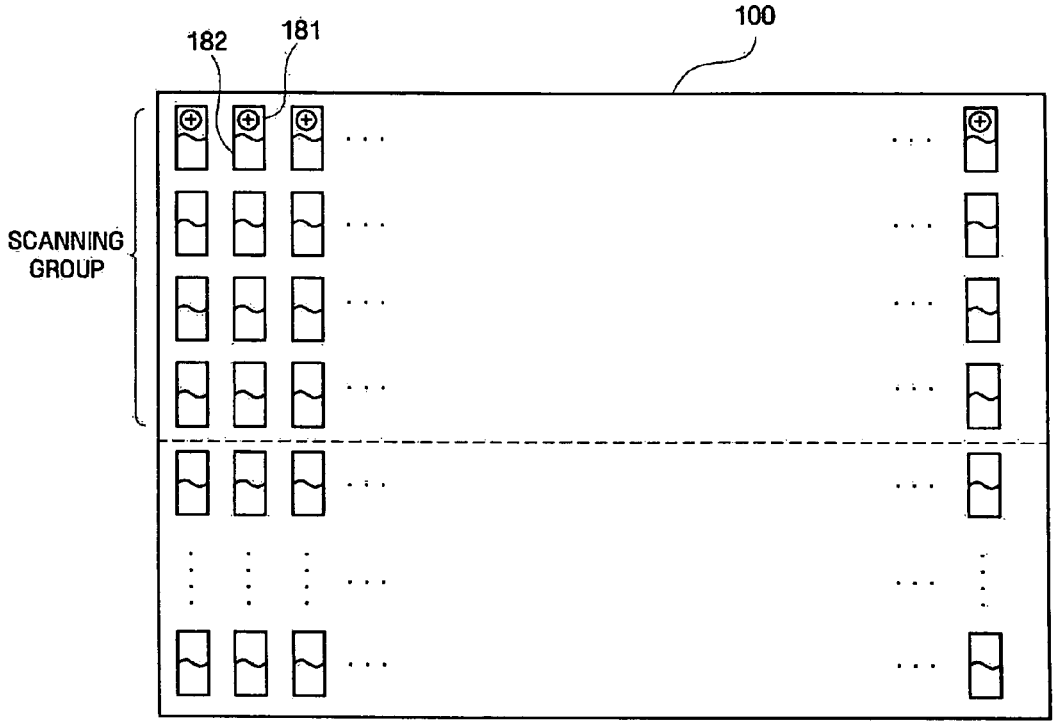

Thereafter, referring to FIGS. 4 and 6, when a gate-on voltage is applied to the first gate line $G_{a+1}$, a first switching device connected to the first gate line $G_{a+1}$ is turned on so that a positive data voltage is applied to a first row of first sub-pixel electrodes corresponding to the first gate line $G_{a+1}$.

Figure 7:
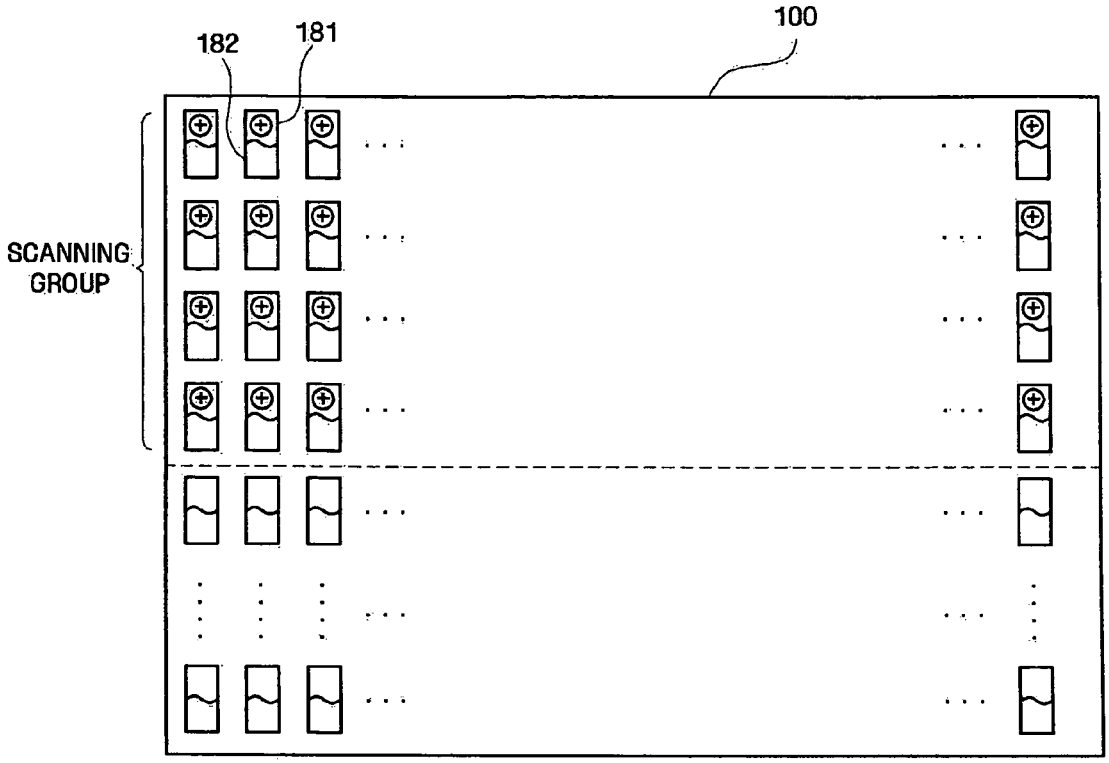

Thereafter, referring to FIGS. 4 and 7, when the gate-on voltage is applied to the first gate lines $G_{a+3}$, $G_{a+5}$, and $G_{a+7}$, which are the third, fifth, and seventh gate lines, respectively, in the selected scanning group, a first switching device connected to the first gate line $G_{a+3}$, a first switching device connected to the first gate line $G_{a+5}$, and a first switching device connected to the first gate line $G_{a+7}$ are sequentially turned on so that a positive data voltage is applied to a second row of first sub-pixel electrodes 181, a third row of first sub-pixel electrodes 181, and a fourth row of first sub-pixel electrodes 181 corresponding to the first gate lines $G_{a+3}$, $G_{a+5}$, and $G_{a+7}$, respectively.

Figure 8:
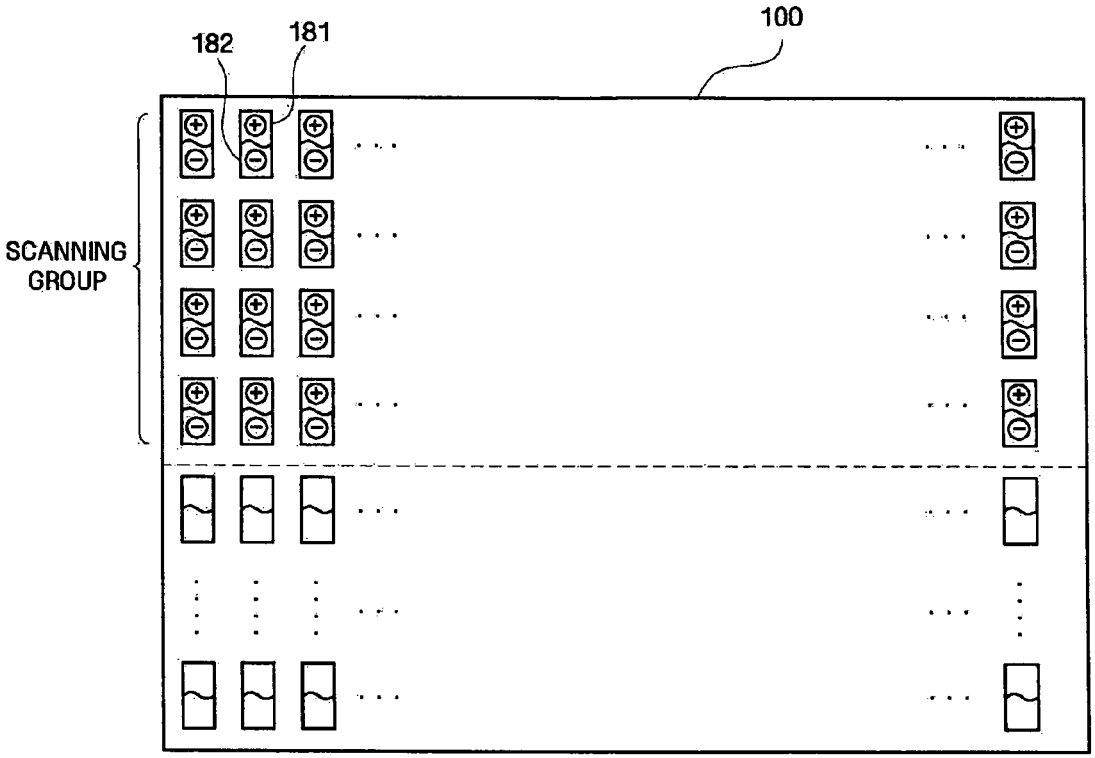

Referring to FIGS. 4 and 8, when the gate-on voltage is applied to the second gate lines $G_{a+2}$, $G_{a+4}$, $G_{a+6}$, and $G_{a+8}$, which are the second, fourth, sixth, and eighth gate lines, respectively, in the selected scanning group, a second switching device connected to the second gate line $G_{a+2}$, a second switching device connected to the second gate line $G_{a+4}$, a second switching device connected to the second gate line $G_{a+6}$, and a second switching device connected to the second gate line $G_{a+8}$ are sequentially turned on so that a negative data voltage is applied to a first row of second sub-pixel electrodes 182, a second row of second sub-pixel electrodes 182, a third row of second sub-pixel electrodes 182, and a fourth row of second sub-pixel electrodes 182 corresponding to the second gate lines $G_{a+2}$, $G_{a+4}$, $G_{a+6}$, and $G_{a+8}$, respectively.

Accordingly, the first through fourth rows of first sub-pixel electrodes 181 are positively charged, and the first through fourth rows of second sub-pixel electrodes 182 are negatively charged. Therefore, as described above with reference to FIG. 1, a lateral field is generated between first and second sub-pixel electrodes 181 and 182 of each pixel. The lateral field and a fringe field generated between a common electrode and the first and second sub-pixel electrodes 181 and 182 of each pixel increase horizontal electric field components, thereby improving the rotational force and response speed of liquid crystal molecules. In addition, since the polarity of data voltages is modified in units of columns of sub-pixel electrodes, it is possible to reduce flickering on a liquid crystal panel by reducing the possibility of liquid crystal molecules deteriorating. Data voltages of opposite polarity may be respectively applied to a pair of adjacent data lines to reduce flicker.

According to an exemplary embodiment of the present invention, data voltages of a first polarity are applied until the charging of the first through fourth rows of first sub-pixel electrodes 181 is terminated, and data voltages of a second polarity are applied until the charging of the first through fourth rows of second sub-pixel electrodes 182 is terminated. The polarity of data voltages toggles only once from positive to negative when the charging of the fourth row of first sub-pixel electrodes 181 is terminated and the charging of the first row of second sub-pixel electrodes 182 begins. The load of a data driving unit which applies data voltages to a liquid crystal panel increases as the amount of variation of the data voltages increases. According to an exemplary embodiment of the present invention the polarity of data voltages toggles only once for each scanning group. Therefore, it is possible to reduce the load of the data driving unit by reducing the degree of variation of the data voltages as compared to a conventional method which requires toggling the polarity of data voltages for every scanning operation.

Referring to FIGS. 4 through 8, the number of first gate lines of the selected scanning group is illustrated as being identical to the number of second gate lines of the selected scanning group. However, the number of first gate lines need not be the same as the number of second gate lines. In addition, referring to FIGS. 4 through 9, the first gate lines $G_{a+1}$, $G_{a+3}$, $G_{a+5}$, and $G_{a+7}$ and the second gate lines $G_{a+2}$, $G_{a+4}$, $G_{a+6}$, and $G_{a+8}$ are sequentially scanned. However, exemplary embodiments of the present invention are not restricted to scanning in this order. For example, the first gate lines $G_{a+1}$, $G_{a+7}$, $G_{a+5}$, and $G_{a+3}$ may be sequentially scanned. The order in which a plurality of first gate lines of a scanning group are to be scanned may be variously altered. Likewise, the order in which a plurality of second gate lines of the scanning group are to be scanned may be variously altered.

In addition, the scanning of a scanning group including a plurality of first gate lines and a plurality of second gate lines need not be performed in such a manner that the second gate lines are scanned only after the scanning of the first gate lines is terminated. For example, the scanning of a scanning group including a plurality of first gate lines and a plurality of second gate lines may be performed in such a manner that two or more first gate lines and two or more second gate lines may be alternately scanned.

Referring to FIG. 4, a scanning group includes a group of consecutive gate lines, including a plurality of adjacent first gate lines, i.e., the first gate lines $G_{a+1}$, $G_{a+3}$, $G_{a+5}$, and $G_{a+7}$, and a plurality of adjacent second gate lines, i.e., the second gate lines $G_{a+2}$, $G_{a+4}$, $G_{a+6}$, and $G_{a+8}$. However, a scanning group may include a plurality of non-consecutive gate lines. In addition, a group of first gate lines constituting a scanning group may not be adjacent to one another, and also, a group of second gate lines constituting the scanning group may not be adjacent to one another.

According an exemplary embodiment of the present invention, a gate driving unit of an LCD selects first and second scanning groups, each including two or more first gate lines and two or more second gate lines, applies a gate-on voltage to the first gate lines of each of the first and second scanning groups according to a first predetermined scanning order, and applies the gate-on voltage to the second gate lines of each of the first and second scanning groups according to a second predetermined scanning order. Here, the number of first gate lines of the first scanning group is identical to the number of first gate lines of the second scanning group, and the number of second gate lines of the first scanning group is identical to the number of second gate lines of the second scanning group.

An LCD according to an exemplary embodiment of the present invention will now be described in detail with reference to FIGS. 9 through 15.

Figure 9:
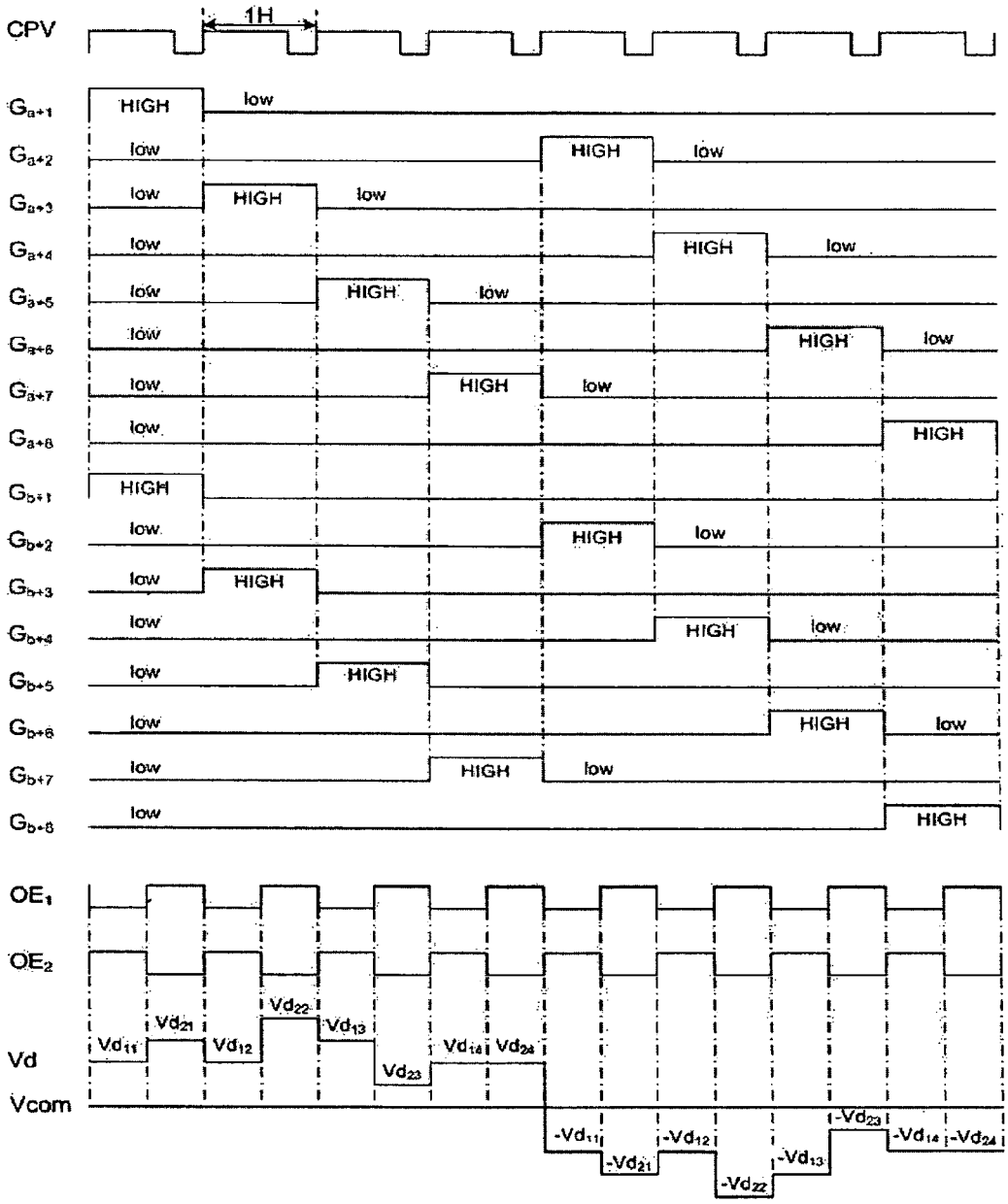
FIG. 9 is a diagram illustrating the waveforms of a gate clock signal, gate signals, output enable signals, and data signals of an LCD according to an exemplary embodiment of the present invention.

FIG. 9 is a diagram illustrating the waveforms of a gate clock signal, gate signals, output enable signals, and data signals of an LCD according to an exemplary embodiment of the present invention.

Referring to FIG. 9, a current gate signal includes a logic high period during which a gate-on voltage is applied and a logic low period during which a gate-off voltage is applied. The current gate signal transitions to a logic high in synchronization with a current rising edge of the gate clock signal CPV received from the signal control unit 430. The current gate signal, which has a logic high level, is divided into two gate signals, and the two gate signals are respectively applied at the same time to two gate lines which are spaced apart. The current gate signal maintains a logic high level for one cycle (i.e., a horizontal period; 1H) of the gate clock signal CPV. The current gate signal transitions to a logic low in synchronization with a subsequent rising edge of the gate clock signal CVP. As soon as the current gate signal transitions to a logic low, a subsequent gate signal transitions to a logic high and is applied to two gate lines according to a predetermined scanning order The predetermined scanning order is determined for two scanning groups, each including two or more first gate lines and two or more second gate lines. A gate driving unit selects at least two scanning groups, i.e., first and second scanning groups. Thereafter, the gate driving unit scans all of a plurality of gate lines belonging to each of the first and second scanning groups first and then scans other gate lines not belonging to any of the first and second scanning groups. Once the scanning of the gate lines belonging to each of the first and second scanning groups begins, other gate lines not belonging to any of the first and second scanning groups are not scanned until the scanning of the gate lines belonging to each of the first and second scanning groups is terminated. The number of gate lines belonging to each of the first and second scanning groups and the number of gate lines not belonging to any of the first and second scanning groups can be determined in various manners.

Referring to FIG. 9, a first scanning group includes a plurality of first gate lines $G_{a+1}$, $G_{a+3}$, $G_{a+5}$, and $G_{a+7}$ and a plurality of second gate lines $G_{a+2}$, $G_{a+4}$, $G_{a+6}$, and $G_{a+8}$, and a second scanning group includes a plurality of first gate lines $G_{b+1}$, $G_{b+3}$, $G_{b+5}$, and $G_{b+7}$ and a plurality of second gate lines $G_{b+2}$, $G_{b+4}$, $G_{b+6}$, and $G_{b+8}$.

According to an exemplary embodiment of the present invention illustrated in FIG. 9, a gate signal having a logic high level is applied to two gate lines at the same time. In general, when a gate-on voltage is applied to two gate lines in response to a gate signal having a logic high level, a data voltage is applied to two pixels, making it difficult to apply different voltages to a plurality of pixels. However, different voltages may be applied to a plurality of pixels by exclusively enabling a gate-on voltage for a pair of gate lines, to which a gate signal having a logic high level is simultaneously applied, so that a gate-on voltage can be prevented from being applied to both of the pair of gate lines at the same time. If the gate-on voltage is applied to one of the pair of gate lines in response to the gate signal, the gate-on voltage may be prevented from being applied to the other gate line. The gate-on voltage may be enabled during a logic high period of the gate signal such that the gate-on voltage is applied to one of the pair of gate lines during the first half of the logic high period of the gate signal and is applied to the other gate line during the second half of the logic high period of the gate signal.

According to an exemplary embodiment of the present invention, a signal control unit controls the enabling of the gate-on voltage by generating first and second output enable signals $OE_1$ and $OE_2$ and transmitting them to the gate driving unit. Each of the first and second output enable signals $OE_1$ and $OE_2$ includes a logic high period and a logic low period. When the first and second output enable signals $OE_1$ and $OE_2$ are logic high, they prevent the gate-on voltage from being output. However, when the first and second output enable signals $OE_1$ and $OE_2$ are logic low, they allow the gate-on voltage to be output. The first and second output enable signals $OE_1$ and $OE_2$ are out of phase with one another. When the first output enable signal $OE_1$ is a logic high, the second output enable signal $OE_2$ is a logic low so that the gate-on voltage is output to one of a pair of gate lines. However, when the first output enable signal $OE_1$ is a logic low, the second output enable signal $OE_1$ is a logic high so that the gate-on voltage is output to the other gate line.

A data voltage waveform Vd includes two data voltages for each period of the gate clock signal CPV. For example, referring to FIG. 9, when a gate signal having a logic high level is applied to the first gate line $G_{a+1}$ belonging to the first scanning group and the first gate line $G_{b+1}$ belonging to the second scanning group and the gate-on voltage is applied to the first gate line $G_{a+1}$ belonging to the first scanning group (i.e., the first output enable signal $OE_1$ is logic low), a first data voltage $Vd_{11}$ is applied to the first gate line $G_{a+1}$ belonging to the first scanning group. Thereafter, when the gate-on voltage is applied to the first gate line $G_{b+1}$ belonging to the second scanning group (i.e., when the second output enable signal $OE_2$ is logic low), a second data voltage $Vd_{21}$ is applied to the first gate line $G_{b+1}$ belonging to the second scanning group. The gate-on voltage is directly applied to the first gate line $G_{a+2}$ and the second gate $G_{b+2}$, the first gate line $G_{a+3}$ and the second gate $G_{b+3}$, the first gate line $G_{a+4}$ and the second gate $G_{b+4}$, the first gate line $G_{a+5}$ and the second gate $G_{b+5}$, the first gate line $G_{a+6}$ and the second gate $G_{b+6}$, the first gate line $G_{a+7}$ and the second gate $G_{b+7}$, and the first gate line $G_{a+8}$ and the second gate $G_{b+8}$. Here, if the gate-on voltage is enabled such that it is applied to one of a pair of gate lines during the first half of a logic high period of a gate signal applied to the pair of gate lines and is applied to the other gate line during the second half of the logic high period of the gate signal, the first and second output enable signals $OE_1$ and $OE_2$ have substantially the same pulse width.

The data voltage waveform Vd includes a plurality of first data voltages $\pm Vd_{11}$, $\pm Vd_{12}$, $\pm Vd_{13}$, and $\pm Vd_{14}$, and a plurality of second data voltages $\pm Vd_{21}$, $\pm Vd_{22}$, $\pm Vd_{23}$, and $\pm Vd_{24}$. In addition, the data voltage waveform Vd is generated by alternating the levels of the first data voltage waveform and the second data voltage waveform with each other, as shown in FIG. 9.

FIGS. 10 through 15 illustrate a method of sequentially applying a data voltage to a plurality of sub-pixel electrodes of a first substrate according to an exemplary embodiment of the present invention.

Referring to FIGS. 10 through 15, a plurality of rectangular pixels are illustrated. Each of the pixels comprises two sub-pixel electrodes, i.e., first and second sub-pixel electrodes 181 and 182. Even though the first sub-pixel electrodes 181 and the respective second sub-pixel electrodes 181 and 182 are electrically separated, they are schematically illustrated in FIGS. 5 through 8 as being connected. In FIGS. 10 through 15, first and second sub-pixel electrodes 181 and 182 that have not yet been supplied with a data voltage for a current frame are charged with a data voltage for a previous frame and are not marked with any symbol. First and second sub-pixel electrodes 181 and 182 that are supplied with a positive data voltage for the current frame are marked with a "+" symbol. First and second sub-pixel electrodes 181 and 182 are supplied with a negative data voltage for the current frame and are marked with a "−" symbol. A positive data voltage is applied to the first sub-pixel electrodes 181 and a negative data voltage is applied to the second sub-pixel electrodes 182. However, according to an exemplary embodiment of the present invention, a negative data voltage is applied to the first sub-pixel electrodes 181 and a positive data voltage is applied to the second sub-pixel electrodes 182.

Figure 10:
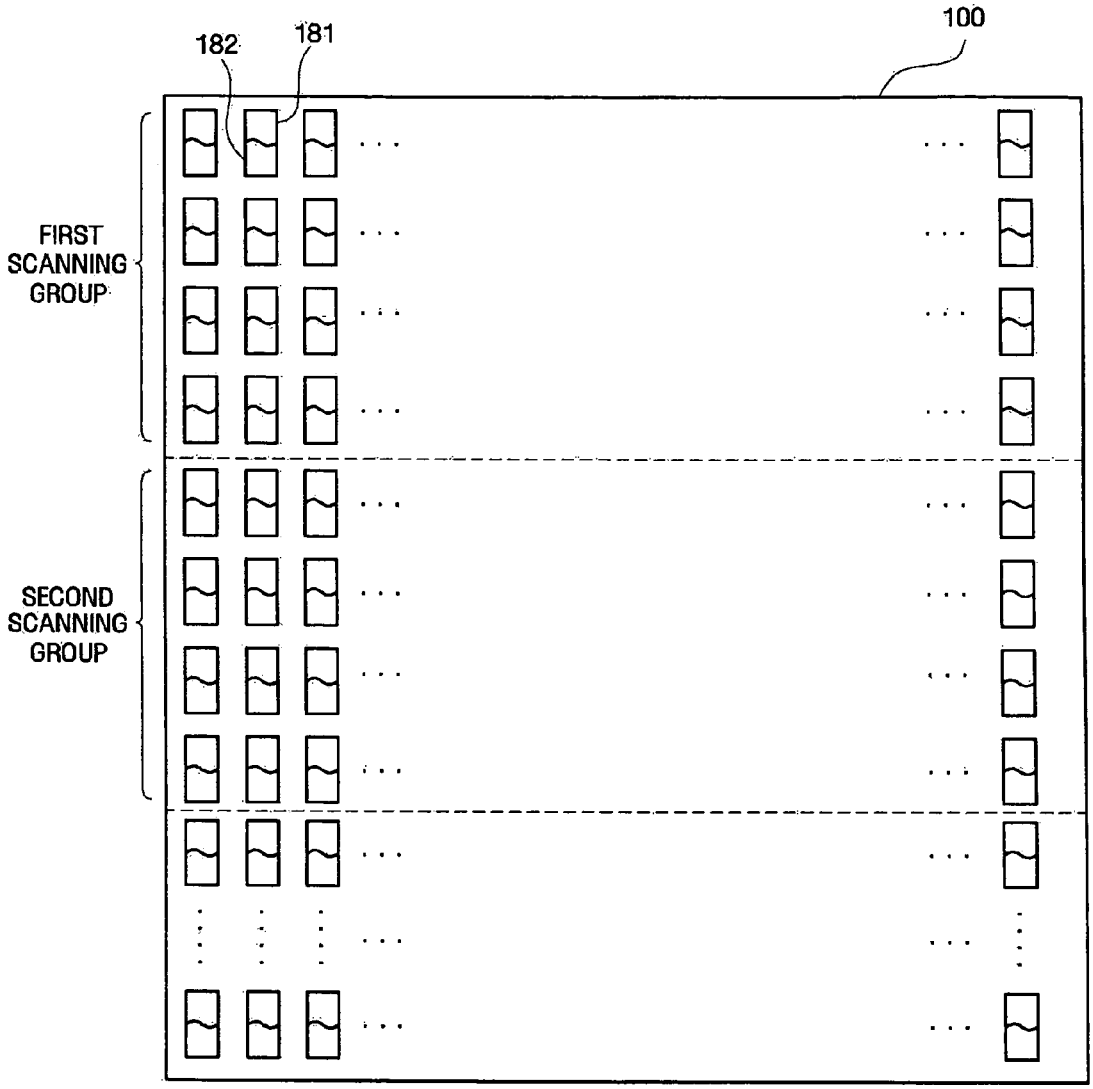
FIGS. 10 through 15 illustrate a method of sequentially applying a data voltage to a plurality of sub-pixel electrodes of a first substrate according to an exemplary embodiment of the present invention.
Figure 11:
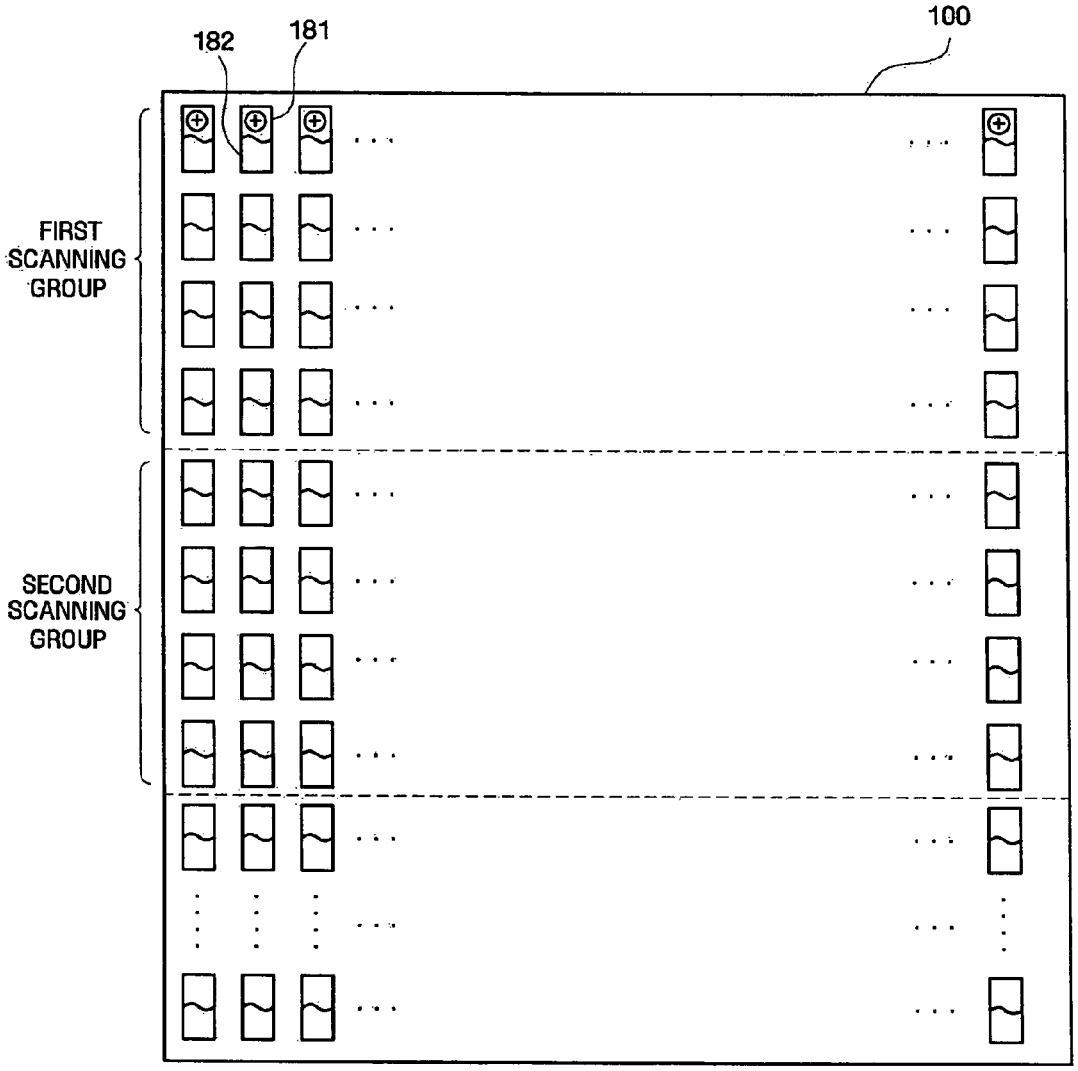

Referring to FIGS. 9 and 10, first and second scanning groups, each including two or more first gate lines and two or more second gate lines, are selected. Referring to FIG. 10, the first scanning group includes first through fourth first gate lines from the top of a first substrate 100 and first through fourth second gate lines from the top of the first substrate 100, and the second scanning group includes fifth through eighth first gate lines from the top of the first substrate 100 and fifth through eighth second gate lines from the top of the first substrate 100. Next, referring to FIGS. 9 and 11, when a gate signal having a logic high level is applied to the first gate line $G_{a+1}$, which is the first gate line of the first scanning group, and the first gate line $G_{b+1}$, which is the first gate line of the second scanning group, the first output enable signal $OE_1$, which controls the applying of a gate-on voltage to the gate lines $G_{a+1}$ through $G_{a+8}$ of the first scanning group, is a logic low, and the second output enable signal $OE_2$, which controls the applying of the gate-on voltage to the gate lines $G_{b+1}$ through $G_{b+8}$ of the second scanning group, is a logic high. Therefore, the first gate line $G_{a+1}$ of the first scanning group is enabled, and the first gate line $G_{b+1}$ of the second scanning group is disabled so that the gate-on voltage is applied only to the first gate line $G_{a+1}$ of the first scanning group. Then, a first switching device connected to the first gate line $G_{a+1}$ of the first scanning group is turned on in response to the gate-on voltage so that a positive data voltage, i.e., the first data voltage $Vd_{11}$, is applied to a first row of first sub-pixel electrodes 181 belonging to the first scanning group.

Figure 12:
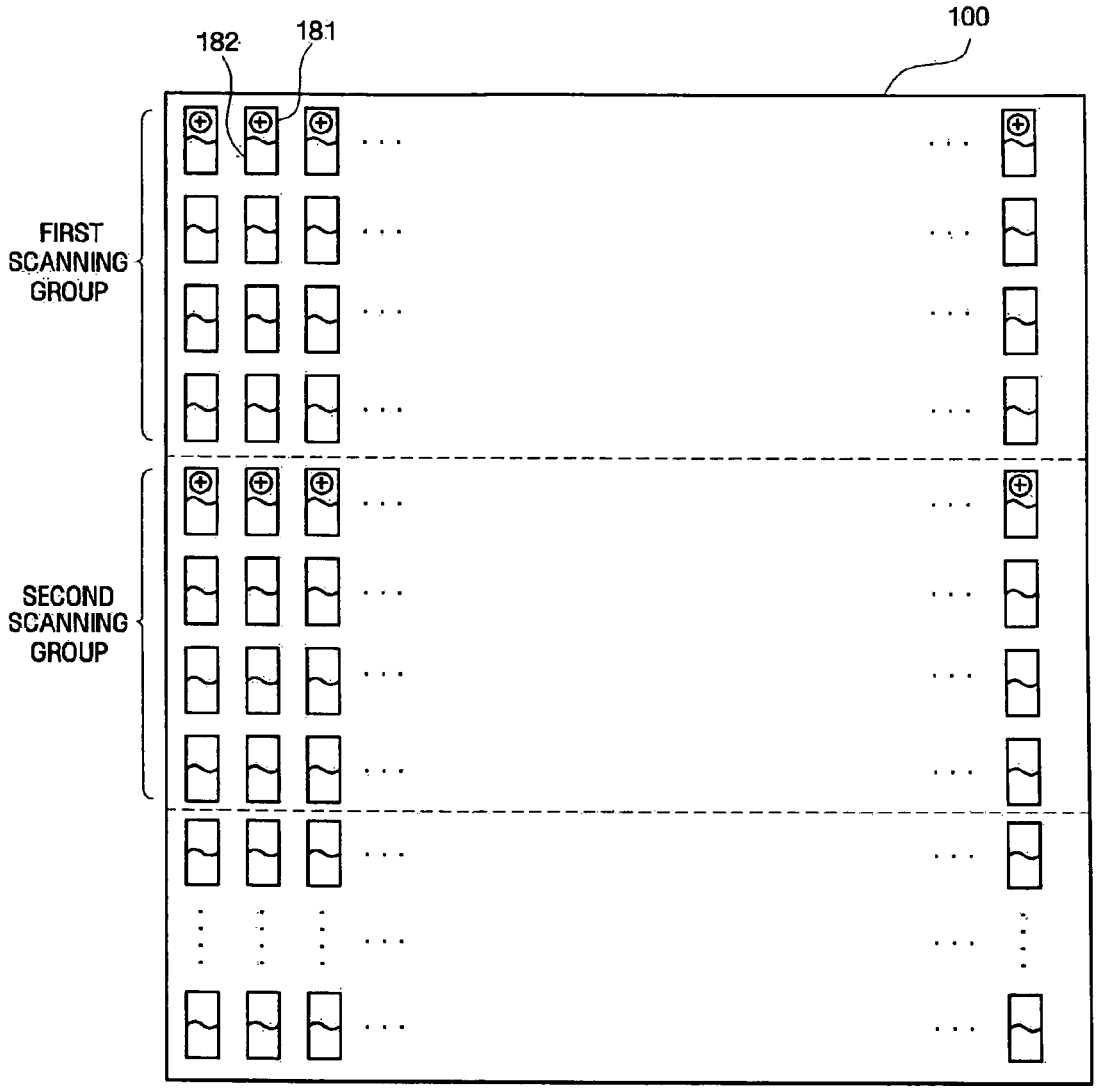

Thereafter, referring to FIGS. 9 and 12, when the first output enable signal $OE_1$ transitions to a logic high and the second output enable signal $OE_2$ transitions to a logic low, the first gate line $G_{a+1}$ of the first scanning group is disabled, and the first gate line $G_{b+1}$ of the second scanning group is enabled so that the gate-on voltage is applied only to the first gate line $G_{b+1}$ of the second scanning group. Then, a first switching device connected to the first gate line $G_{b+1}$ of the second scanning group is turned on so that a positive data voltage, i.e., the second data voltage $Vd_{21}$, is applied to a first row of first sub-pixel electrodes 181 belonging to the second scanning group.

Figure 13:
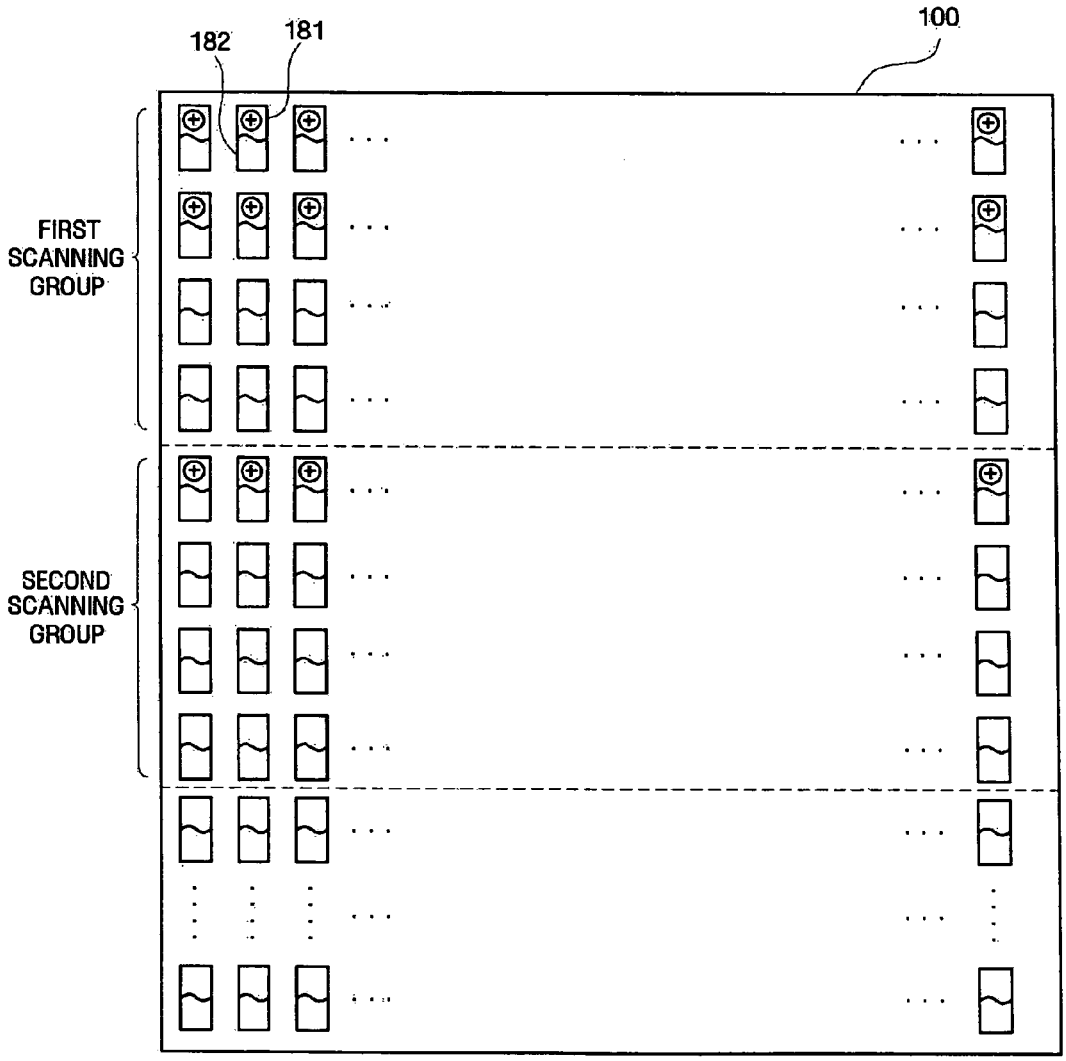

Next, referring to FIGS. 9 and 13, when the gate signal applied to the first gate line $G_{a+1}$ of the first scanning group and the first gate line $G_{b+1}$ of the second scanning group transitions to a logic low, a gate signal having a logic high level is applied to the first gate line $G_{a+3}$, which is the third gate line of the first scanning group, and the second gate line $G_{b+3}$, which is the third gate line of the second scanning group. Then, the first output enable signal $OE_1$ transitions to a logic low, and the second output enable signal $OE_2$ transitions to a logic high. As a result, the first gate line $G_{a+3}$ of the first scanning group is enabled, and the first gate line $G_{b+3}$ of the second scanning group is disabled so that the gate-on voltage is applied only to the first gate line $G_{a+3}$ of the first scanning group. Thereafter, a first switching device connected to the first gate line $G_{a+3}$ of the first scanning group is turned on in response to the gate-on voltage so that a positive data voltage, i.e., the first data voltage $Vd_{12}$, is applied to a second row of first sub-pixel electrodes 181 belonging to the first scanning group.

Figure 14:
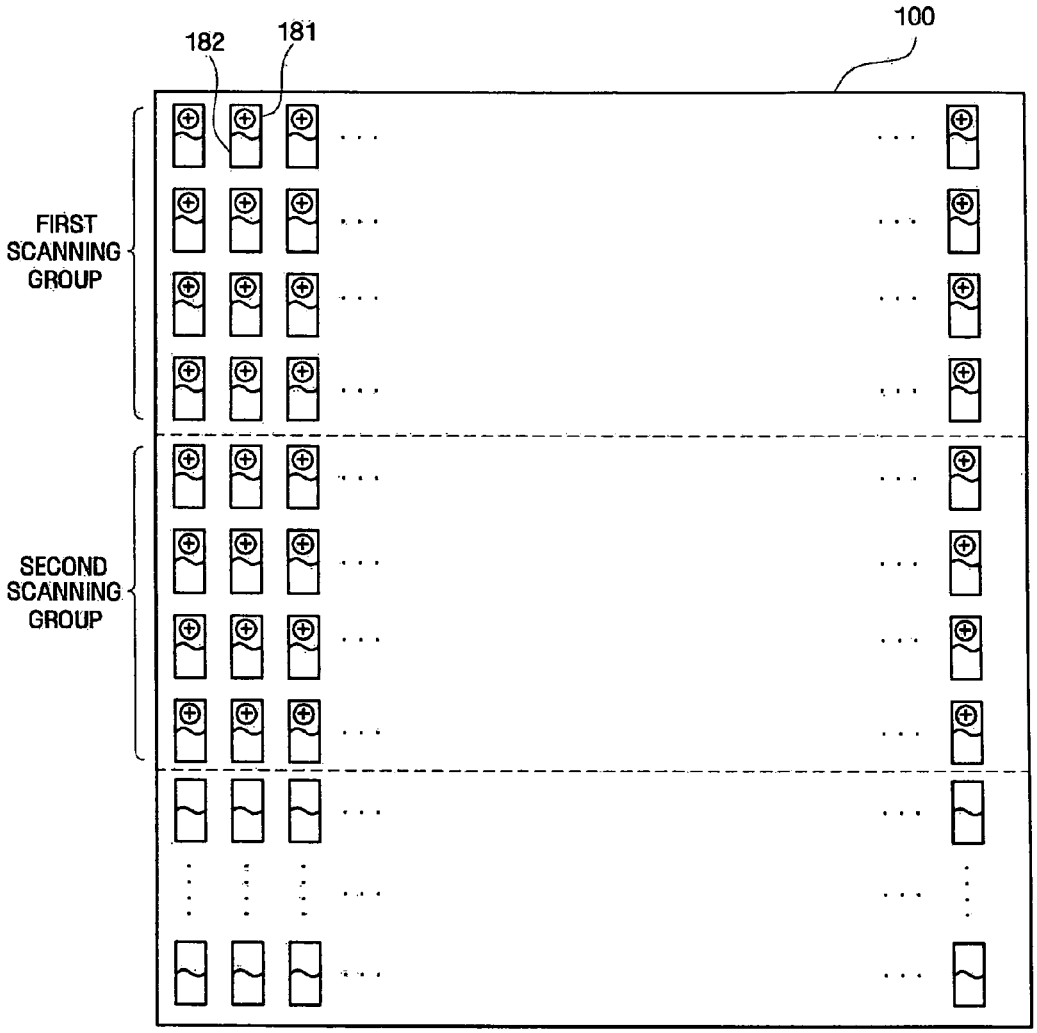

Next, referring to FIGS. 9 and 14, the gate-on voltage is sequentially applied to the first gate line $G_{b+3}$, which is the third gate line of the second scanning group, the first gate line $G_{a+5}$, which is the fifth gate line of the first scanning group, the first gate line $G_{b+5}$, which is the fifth gate line of the second scanning group, the first gate line $G_{a+7}$, which is the seventh gate line of the first scanning group, and the first gate line $G_{b+7}$, which is the seventh gate line of the second scanning group. Accordingly, a plurality of first switching devices respectively connected to the first gate line $G_{b+3}$, the first gate line $G_{a+5}$, the first gate line $G_{b+5}$, the first gate line $G_{a+7}$, and the first gate line $G_{b+7}$ are sequentially turned on so that a positive data voltage, i.e., the first data voltage $Vd_{22}$, is applied to a second row of first sub-pixel electrodes 181 belonging to the second scanning group, a positive data value, i.e., the first data voltage $Vd_{13}$, is applied to a third row of first sub-pixel electrodes 181 belonging to the first scanning group; a positive data voltage, i.e., the first data voltage $Vd_{23}$, is applied to a third row of first sub-pixel electrodes 181 belonging to the second scanning group, a positive data voltage, i.e., the first data voltage $Vd_{14}$, is applied to a fourth row of first sub-pixel electrodes 181 belonging to the first scanning group, and a positive data voltage, i.e., the first data voltage $Vd_{24}$, is applied to a fourth row of first sub-pixel electrodes 181 belonging to the second scanning group.

Figure 15:
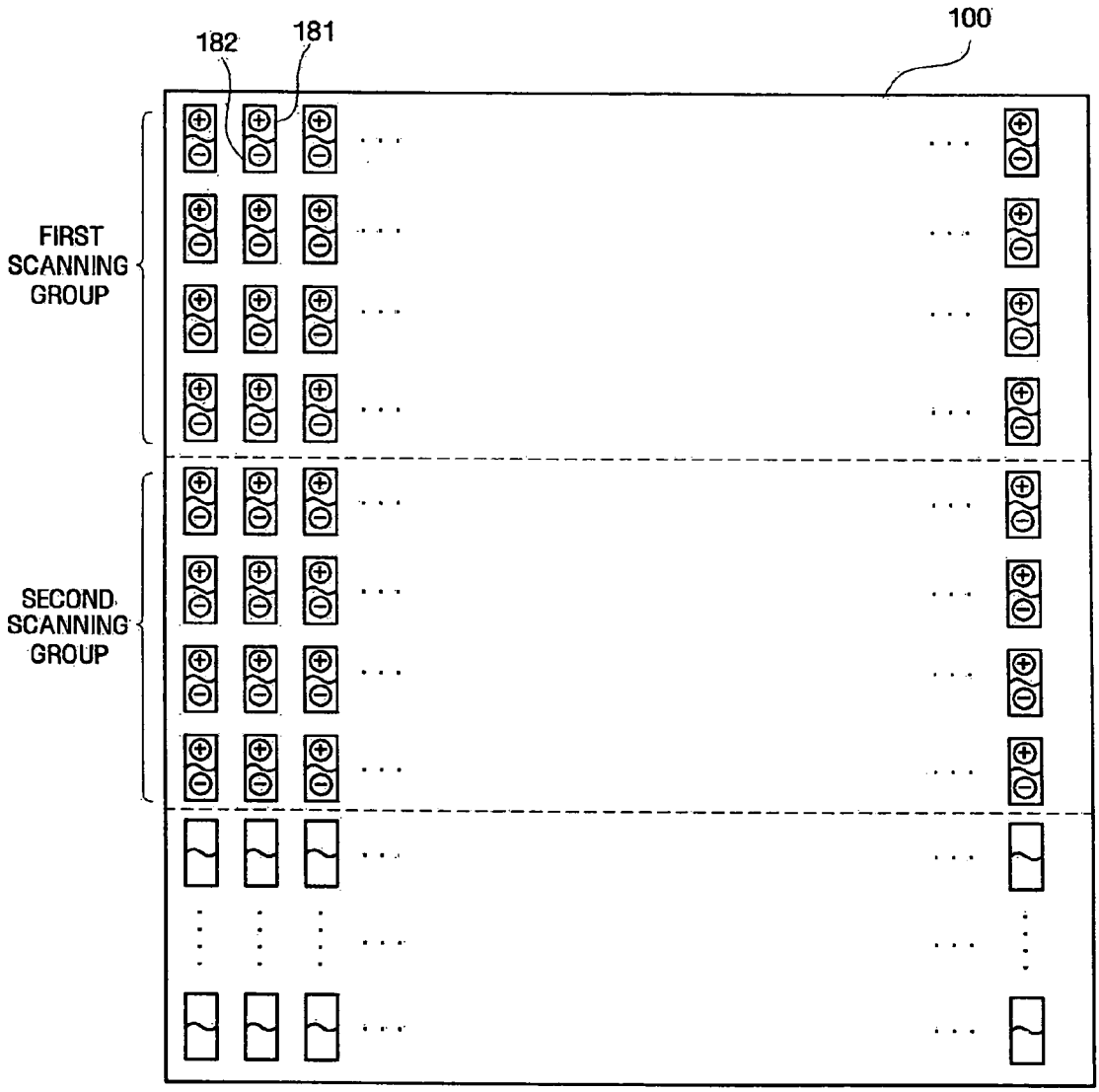

Thereafter, referring to FIGS. 9 and 15, the gate-on voltage is sequentially applied to the second gate line $G_{a+2}$, which is the second gate line of the first scanning group, the second gate line $G_{b+2}$, which is the second gate line of the second scanning group, the second gate line $G_{a+4}$, which is the fourth gate line of the first scanning group, the second gate line $G_{b+4}$, which is the fourth gate line of the second scanning group, the second gate line $G_{a+6}$, which is the sixth gate line of the first scanning group, the second gate line $G_{b+6}$, which is the sixth gate line of the second scanning group, the second gate line $G_{a+8}$, which is the eighth gate line of the first scanning group, and the second gate line $G_{b+8}$, which is the eighth gate line of the second scanning group. Accordingly, a plurality of second switching devices respectively connected to the second gate line $G_{a+2}$, the second gate line $G_{b+2}$, the second gate line $G_{a+4}$, the second gate line $G_{b+4}$, the second gate line $G_{a+6}$, the second gate line $G_{b+6}$, the second gate line $G_{a+8}$, and the second gate line $G_{b+8}$ are sequentially turned on so that a negative data voltage, i.e., the second data voltage $-Vd_{11}$, is applied to a first row of second sub-pixel electrodes 182 belonging to the first scanning group, a negative data voltage, i.e., the second data voltage $-Vd_{21}$, is applied to a first row of second sub-pixel electrodes 182 belonging to the second scanning group, a negative data voltage, i.e., the second data voltage $-Vd_{12}$, is applied to a second row of second sub-pixel electrodes 182 belonging to the first scanning group, a negative data voltage, i.e., the second data voltage $-Vd_{22}$, is applied to a second row of second sub-pixel electrodes 182 belonging to the second scanning group, a negative data voltage, i.e., the second data voltage $-Vd_{13}$, is applied to a third row of second sub-pixel electrodes 182 belonging to the first scanning group, a negative data voltage, i.e., the second data voltage $-Vd_{23}$, is applied to a third row of second sub-pixel electrodes 182 belonging to the second scanning group, a negative data voltage, i.e., the second data voltage $-Vd_{14}$, is applied to a fourth row of second sub-pixel electrodes 182 belonging to the first scanning group, and a negative data voltage, i.e., the second data voltage $-Vd_{24}$, is applied to a fourth row of second sub-pixel electrodes 182 belonging to the first scanning group.

Therefore, the first through fourth rows of first sub-pixel electrodes 181 belonging to each of the first and second scanning groups are positively charged, and the first through fourth rows of second sub-pixel electrodes 182 belonging to each of the first and second scanning groups are negatively charged. As described above with reference to FIG. 1, a lateral field is generated between first and second sub-pixel electrodes 181 and 182 of each pixel. The lateral field strengthens a horizontal electric field together with a fringe field generated between a common electrode and the first and second sub-pixel electrodes 181 and 182 of each pixel, thereby improving the rotational force and response speed of liquid crystal molecules. In addition, since the polarity of data voltages is changed in units of columns of sub-pixel electrodes, it is possible to reduce flickering on a liquid crystal panel by reducing the possibility of liquid crystal molecules deteriorating. Data voltages of opposite polarity may be respectively applied to a pair of adjacent data lines to reduce flicker.

According to an exemplary embodiment of the present invention, data voltages of a first polarity are applied until the charging of the first through fourth rows of first sub-pixel electrodes 181 belonging to the first scanning group and the first through fourth rows of first sub-pixel electrodes 182 belonging to the second scanning group is terminated, and data voltages of a second polarity are applied until the charging of the first through fourth rows of second sub-pixel electrodes 182 belonging to the first scanning group and the first through fourth rows of second sub-pixel electrodes 182 belonging to the second scanning group is terminated. The polarity of data voltages toggles only once from positive to negative when the charging of the fourth row of first sub-pixel electrodes 181 belonging to the first scanning group is terminated and the charging of the first row of second sub-pixel electrodes 182 belonging to the second scanning group begins. The load of a data driving unit which applies data voltages to a liquid crystal panel increases as the amount of variation in the data voltages increases. According to an exemplary embodiment of the present invention, the polarity of data voltages toggles only once for each scanning group. Therefore, it is possible to reduce the load of the data driving unit by reducing the degree of variation of data voltages compared to a conventional method which requires toggling the polarity of data voltages for every scanning operation.

According to an exemplary embodiment of the present invention illustrated in FIGS. 9 through 15, a gate signal having 2 logic levels during one period of a gate clock signal is applied to a gate line, thus halving the period of the gate clock signal. Therefore, it is possible to reduce the load of a signal control unit which generates the gate clock signal and the load of a gate driving unit.

While FIGS. 9 through 15 has illustrated that the first and second scanning groups are two consecutively selected scanning groups, the present invention is not restricted thereto. Rather, the first and second scanning groups need not be consecutive scanning groups as long as they are not identical or have some gate lines in common. A region where the first scanning group is formed may overlap a region where the second scanning group is formed. In addition, FIGS. 9 through 15 illustrate that the number of first gate lines belonging to the first scanning group is identical to the number of first gate lines belonging to the second scanning group, and the number of second gate lines belonging to the first scanning group is identical to the number of second gate lines belonging to the second scanning group. However, according to an exemplary embodiment of the present invention, the number of first gate lines belonging to the first scanning group is different from the number of first gate lines belonging to the second scanning group and the number of second gate lines belonging to the first scanning group is different from the number of second gate lines belonging to the second scanning group. FIGS. 9 through 15 further illustrates that the scanning of the first gate lines and the second gate lines belonging to each of the first and second scanning group is performed in a downward direction. However, the order in which the first gate lines and the second gate lines belonging to each of the first and second scanning group are to be scanned can be variously determined.

The scanning of the first and second scanning groups need not be performed in such a manner that the second gate lines of the first and second scanning groups are scanned only after the scanning of the first gate lines of the first and second scanning groups. The scanning of the first and second scanning groups may be performed in such a manner that two or more first gate lines and two or more second gate lines may be alternately scanned.

In addition, while FIGS. 9 through 15 have illustrated that first gate lines and second gate lines included in each of the first and second scanning groups include all consecutive gate lines and the first and second sub-pixel electrodes are connected by first and second switching devices connected to the first and second gate lines, to each of which a data voltage is applied, constituting a pixel, respectively, the present invention is not restricted thereto. Non-consecutive gate lines, e.g., a first gate line and a second gate line that is separated from the first gate line, may be selected as being included in a scanning group. In addition, a scanning group may include a plurality of non-adjacent first gate lines and a plurality of non-adjacent second gate lines.

Furthermore, the scanning is not restricted to simultaneously scanning of two scanning groups. Three or more scanning groups may be simultaneously scanned.

In an exemplary embodiment of the present invention, a data voltage is applied to one of a pair of sub-pixel electrodes of a pixel, and a predetermined time period later, to one of a pair of sub-pixel electrodes of another pixel. The predetermined time period may be within a certain range. For example, when a liquid crystal panel comprises a total of 768 columns of pixels and has a frame frequency of 60 Hz, the duration of a frame is about 16.7 ms. If rising and falling times of the liquid crystal panel are both 6 ms and the time needed for aligning liquid crystal molecules corresponding to a pixel in response to a charge voltage is 8 ms, a margin of 2 ms may be needed to prevent the liquid crystal molecules from being aligned in response to another charge voltage. Therefore, the predetermined time period may be 2.7 ms or less. In other words, the predetermined time period may be a maximum of 2.7 ms during the applying of a gate-on voltage to a first gate line or a second gate line of each scanning group.

When the predetermined time period is a maximum of 2.7 ms, a data voltage is applied to a row of pixels for about 21.7 μs. To ensure that the predetermined time period can be 2.7 ms or less, an adequate margin is required to charge up to about 124.4 sub-pixel electrodes including a sub-pixel electrode charged first. The number of first gate lines or second gate lines belonging to each scanning group may be set to 124 or less to fulfill this requirement.

Figure 16:
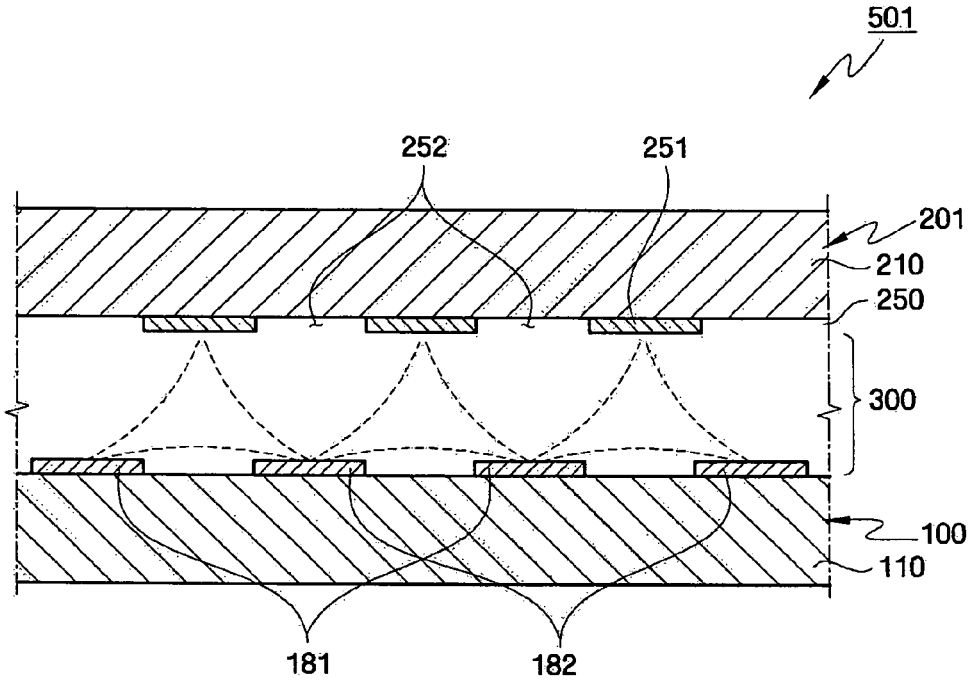
FIGS. 16 through 18 are cross-sectional views of LCDs according to exemplary embodiments of the present invention.
Figure 17:
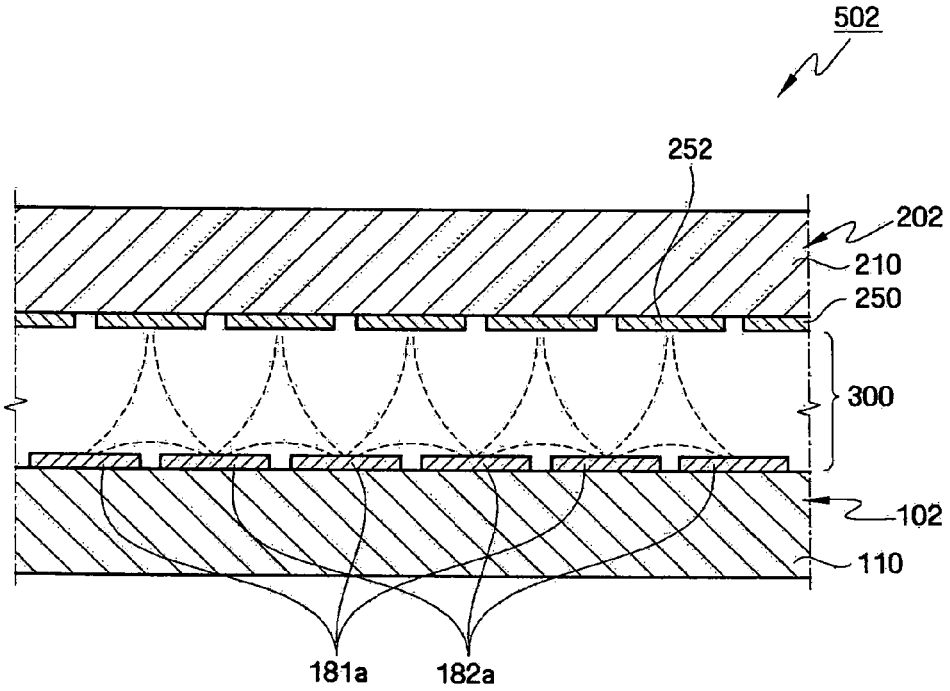
Figure 18:
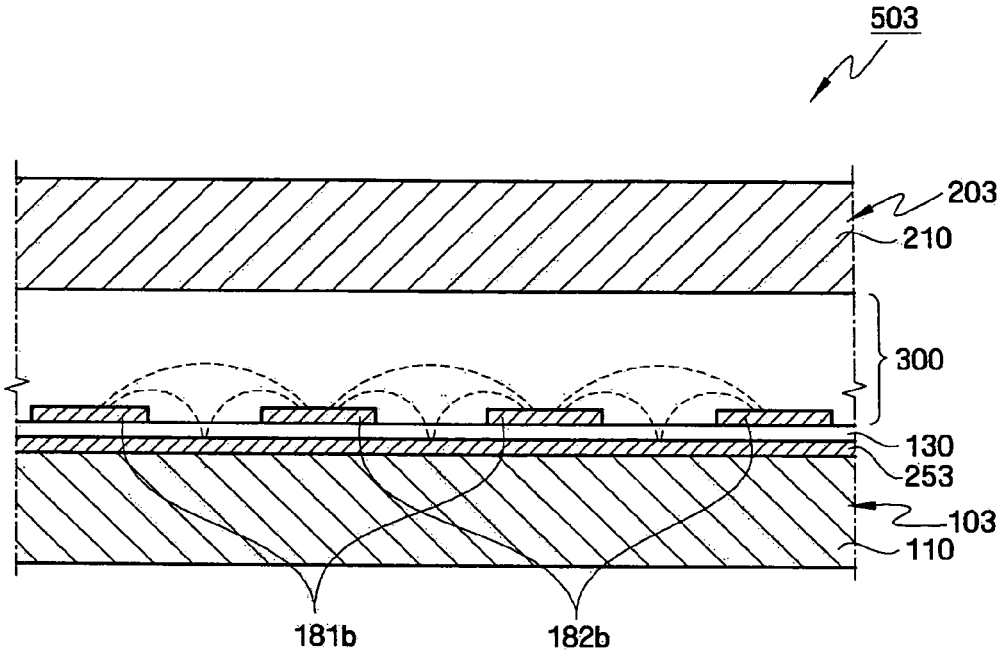

While the illustrated embodiments of the present invention have been shown with regard to LCDs each including a liquid crystal panel having the structure illustrated in FIG. 1 by way of example, the present invention is not restricted thereto. The present invention can be applied to a variety of LCDs having a different structure from the one illustrated in FIG. 1. FIGS. 16, 17, and 18 are cross-sectional views of LCDs 501, 502, and 503, respectively, according to exemplary embodiments of the present invention.

Referring to FIG. 16, the structure of the LCD 501 is different from the LCD 500 illustrated in FIG. 1 in that a common electrode 251 is formed on a second insulation substrate 210 of a second substrate 201 through patterning. The common electrode 251 includes a plurality of apertures 252. The width of the apertures 252 may be greater than the width of first and second sub-pixel electrodes 181 and 182. The direction of an electric field on a liquid crystal layer 300 is substantially similar to the LCD 500 illustrated in FIG. 1. Liquid crystal molecules of the liquid crystal layer 300 are initially aligned in a horizontal direction.

Referring to the LCD 502 of FIG. 17, first and second sub-pixel electrodes 181*a* and 182*a* are formed on a first insulation substrate 210 of a first substrate 102, and a common electrode 252 is formed on a second insulation substrate 210 of a second substrate 202 through patterning. Liquid crystal molecules of a liquid crystal layer 300 are initially aligned in a vertical direction. A plurality of pixels are grouped into a plurality of domains by lateral fields and fringe fields which are generated by the first and second sub-pixel electrodes 181*a* and 182*b* and the common electrode 252.

Referring to the LCD 503 of FIG. 18, a common electrode 253 is formed on the entire surface of a first insulation substrate 110 of a first substrate 103. First and second sub-pixel electrodes 181*b* and 182*b* are formed on the common electrode 253 and are insulated from the common electrode 253 by a gate insulation layer 130. A horizontal electric field is generated. The common electrode 253 may be formed through patterning.

Lateral fields can be generated in the LCDs 501 through 503 of FIGS. 16 through 18 by applying data voltages of different polarities to first and second sub-pixel electrodes. Each of the LCDs 501 through 503 of FIGS. 16 through 18 comprises a gate driving unit.

According to an exemplary embodiment of the present invention, voltages of opposite polarities are respectively applied to first and second sub-pixel electrodes so that data voltages of the first polarity are applied to a scanning group and data voltages of the second polarity are applied to the scanning group. Therefore, data voltages applied by a data driving unit are not much different from one another. Accordingly, the load due to the data driving unit can be reduced.

Furthermore, the load of the data driving unit can be reduced by applying a gate signal having a logic high level to two scanning groups at the same time to reduce the frequency of a gate clock signal.

Although the present invention has been described in connection with the exemplary embodiments of the present invention, it will be apparent to those skilled in the art that various modifications and changes may be made thereto without departing from the scope and spirit of the invention. Therefore, it should be understood that the above embodiments are not limitative, but illustrative in all aspects.

What is claimed is:

1. A display apparatus comprising:

a plurality of data lines which transmit a data signal received from a data driving unit;

a plurality of first gate lines and a plurality of second gate lines, which cross the data lines and are arranged in such a manner that the first gate lines and the second gate lines alternate with each other;

a plurality of pixels, at least one of the pixels comprising a first sub-pixel electrode to which a first data voltage is applied by a first switching device connected to one of the first gate lines and a second sub-pixel electrode to which a second data voltage is applied by a second switching device connected to one of the second gate lines; and a gate driving unit which selects a scanning group comprising at least two of the first gate lines and at least two of the second gate lines, wherein the gate driving unit applies a gate-on voltage to the first gate lines of the scanning group according to a first predetermined scanning order to drive the first sub-pixel of the at least one pixel, before applying the gate-on voltage to the second gate lines of the scanning group according to a second predetermined scanning order to drive the second sub-pixel of the at least one pixel, wherein the first switching device and the second switching device are connected to a same one of the data lines, and the gate lines to which the first and second switching devices are connected are separate and distinct from one another, wherein data voltages respectively applied to the first and second sub-pixel electrodes in a same frame have a same absolute value and opposite polarities with respect to a reference voltage.

2. The display apparatus of claim 1, wherein the scanning group comprises a consecutive plurality of the first gate lines and a consecutive plurality of the second gate lines.

3. The display apparatus of claim 2, wherein the gate driving unit sequentially applies the gate-on voltage to the first gate lines and the second gate lines of the scanning group.

4. The display apparatus of claim 1, wherein the number of the first gate lines belonging to the scanning group is identical to the number of the second gate lines belonging to the scanning group.

5. The display apparatus of claim 1, further comprising a liquid crystal layer which is formed on the first and second sub-pixel electrodes.

6. The display apparatus of claim 5, further comprising:

a common electrode which faces the first and second sub-pixel electrodes with the liquid crystal layer interposed between the common electrode and the first and second sub-pixel electrodes;

a first alignment layer which is interposed between the liquid crystal layer and the first and second sub-pixel electrodes and is rubbed in a first direction; and a second alignment layer which is interposed between the liquid crystal layer and the common electrode and is rubbed in a second direction.

7. The display apparatus of claim 6, wherein the common electrode comprises a plurality of apertures which are wider than the first and second sub-pixel electrodes.

8. A display apparatus comprising:

a plurality of data lines which transmit a data signal received from a data driving unit;

a plurality of first gate lines and a plurality of second gate lines, which cross the data lines and are arranged in such a manner that the first gate lines and the second gate lines alternate with each other;

a plurality of pixels, at least one of the pixels comprising a first sub-pixel electrode to which a first data voltage is applied by a first switching device connected to one of the first gate lines and a second sub-pixel electrode to which a second data voltage is applied by a second switching device connected to one of the second gate lines;

a gate driving unit which selects first and second scanning groups, each scanning group comprising at least two of the first gate lines and at least two of the second gate lines; and a signal control unit that outputs first and second output enable signals to the gate driving unit that toggle between a logic low and a high and are out of phase with one another, wherein the gate driving unit applies a gate-on voltage to the first gate lines of each of the first and second scanning groups according to a first predetermined scanning order before applying the gate-on voltage to the second gate lines of each of the first and second scanning groups according to a second predetermined scanning order, wherein the first and second scanning groups do not have any gate lines in common, wherein the first switching device and the second switching device are connected to a same one of the data lines, and the gate lines to which the first and second switching devices are connected are separate and distinct from one another, wherein when the gate-on voltage is applied to a gate line of both scanning groups for a period, the gate driving unit uses the output enable signals to disable one of these gate lines for part of the period, and wherein data voltages respectively applied to the first and second sub-pixel electrodes in a same frame have a same absolute value and opposite polarities with respect to a reference voltage.

9. The display apparatus of claim 8, wherein each of the first and second scanning groups comprises a consecutive plurality of the first gate lines and a consecutive plurality of the second gate lines.

10. The display apparatus of claim 9, wherein the gate driving unit sequentially applies the gate-on voltage to gate lines of each of the first and second scanning groups.

11. The display apparatus of claim 8, wherein the number of first gate lines belonging to each of the first and second scanning groups is identical to the number of second gate lines belonging to each of the first and second scanning groups.

12. The display apparatus of claim 8, wherein the number of first gate lines of the first scanning group is identical to the number of first gate lines of the second scanning group, and the number of second gate lines of the first scanning group is identical to the number of second gate lines of the second scanning group.

13. The display apparatus of claim 8, wherein the gate-on voltage applied to the gate lines of each of the first and second scanning groups have the same pulse width and are exclusively enabled in the same scanning order.

14. The display apparatus of claim 13, wherein the data signal comprises a first data voltage applied to the first scanning group and a second data voltage applied to the second scanning group, and the first data voltage and the second data voltage alternate with each other.

15. The display apparatus of claim 8 further comprising a liquid crystal layer which is formed on the first and second sub-pixel electrodes.

16. The display apparatus of claim 15 further comprising:

a common electrode which faces the first and second sub-pixel electrodes with the liquid crystal layer interposed between the common electrode and the first and second sub-pixel electrodes;

a first alignment layer which is interposed between the liquid crystal layer and the first and second sub-pixel electrodes and is rubbed in a first direction; and a second alignment layer which is interposed between the liquid crystal layer and the common electrode and is rubbed in a second direction.

17. The display apparatus of claim 16, wherein the common electrode comprises a plurality of apertures which are wider than the first and second sub-pixel electrodes.

18. A method of driving a display apparatus comprising a plurality of data lines which transmit a data signal, a plurality of first gate lines and a plurality of second gate lines which cross the data lines and are arranged in such a manner that a first gate line and a second gate line alternate with each other, and a plurality of pixels, at least one of the pixels comprising a first sub-pixel electrode to which a first data voltage is applied by a first switching device connected to one of the first gate lines and a second adjacent sub-pixel electrode to which a second data voltage is applied by a second switching device connected to one of the second gate lines, the method comprising:

selecting a scanning group comprising at least two of the first gate lines and at least two of the second gate lines;

applying a gate-on voltage to the first gate lines of the scanning group according to a first predetermined scanning order to drive the first sub-pixel of the at least one pixel; and applying the gate-on voltage to the second gate lines of the scanning group according to a second predetermined scanning order after the applying of the gate-on voltage to the first gate lines to drive the second sub-pixel of the at least one pixel, wherein the first switching device and the second switching device are connected to a same one of the data lines, and the gate lines to which the first and second switching devices are connected are separate and distinct from one another, wherein the data voltages respectively applied to the adjacent first and second sub-pixel electrodes in a same frame have a same absolute value and opposite polarities.

19. The method of claim 18, wherein the data signal includes the first data voltage and the second data voltage, and applying the gate-on voltage to the first and second gate lines of the scanning group comprises:

turning on the first switching device by applying the gate-on voltage to the first gate lines of the scanning group;

applying the first data voltage to sub-pixel electrodes connected to the first switching device;

turning on the second switching device by applying the gate-on voltage to the second gate lines of the scanning group; and applying the second data voltage to sub-pixel electrodes connected to the second switching device.

20. The display apparatus of claim 8, wherein a data voltage is applied to the first gate lines or the second gate lines of each of the first and second scanning groups for up to 2.7 ms and the number of each of the first and second scanning groups is 124 or less.

* * * * *